US011317198B2

(12) United States Patent
Li et al.

(10) Patent No.: US 11,317,198 B2
(45) Date of Patent: Apr. 26, 2022

(54) LOUDSPEAKER SYSTEM, LOUDSPEAKER, AND LOUDSPEAKER BASE

(71) Applicant: Tencent Technology (Shenzhen) Company Limited, Guangdong (CN)

(72) Inventors: Kaifeng Li, Shenzhen (CN); Ziming Wang, Shenzhen (CN); Chenggong Ning, Shenzhen (CN); Yihong Xie, Shenzhen (CN); Minghua Li, Shenzhen (CN); Peitao Wang, Shenzhen (CN); Jin Fang, Shenzhen (CN)

(73) Assignee: Tencent Technology (Shenzhen) Company Limited, Shenzhen (CN)

( * ) Notice: Subject to any disclaimer, the term of this patent is extended or adjusted under 35 U.S.C. 154(b) by 0 days.

(21) Appl. No.: 17/113,384

(22) Filed: Dec. 7, 2020

(65) Prior Publication Data

US 2021/0176561 A1 Jun. 10, 2021

Related U.S. Application Data

(63) Continuation of application No. PCT/CN2019/112685, filed on Oct. 23, 2019.

(30) Foreign Application Priority Data

Oct. 26, 2018 (CN) ..... 201811260256.0
Nov. 30, 2018 (CN) ..... 201822009698.X
(Continued)

(51) Int. Cl.
*H04R 1/34* (2006.01)
*H04R 1/02* (2006.01)

(52) U.S. Cl.
CPC ..... *H04R 1/345* (2013.01); *H04R 1/025* (2013.01); *H04R 2499/11* (2013.01)

(58) Field of Classification Search
CPC ..... H04R 1/345; H04R 1/025; H04R 2499/11
(Continued)

(56) References Cited

U.S. PATENT DOCUMENTS 9,381,430 B2 * 7/2016 Reiche ..... A63F 13/40
10,108,924 B2 * 10/2018 Wane ..... G06Q 10/087
(Continued)

FOREIGN PATENT DOCUMENTS

CN 203233513 10/2013
CN 107340991 11/2017
(Continued)

OTHER PUBLICATIONS

International Search Report dated Jan. 23, 2020 in PCT Application No. PCT/CN2019/112685, filed Oct. 23, 2019 (with English Translation).

(Continued)

*Primary Examiner* — Sean H Nguyen
(74) *Attorney, Agent, or Firm* — Arentfox Schiff LLP

(57) ABSTRACT

A loudspeaker system includes a loudspeaker base and a loudspeaker peripheral that is independent of the loudspeaker base. The loudspeaker peripheral is shaped as a role figure. The loudspeaker base and the loudspeaker peripheral connect through a contact connection or a non-contact connection, and provide personalized voice data corresponding to the role figure when connected.

20 Claims, 30 Drawing Sheets

(30) Foreign Application Priority Data

Nov. 30, 2018 (CN) ..... 201921171443.1
Nov. 30, 2018 (CN) ..... 201921172271.X
Aug. 6, 2019 (CN) ..... 201921277323.X

(58) Field of Classification Search
USPC ..... 381/386
See application file for complete search history.

(56) References Cited

U.S. PATENT DOCUMENTS

| | | | | |
|---|---|---|---|---|
| 10,315,119 | B2 * | 6/2019 | Reiche | A63F 13/95 |
| 2014/0333025 | A1 * | 11/2014 | Amireh | A63F 1/02 273/293 |
| 2017/0245032 | A1 | 8/2017 | Yoon et al. | |
| 2019/0027129 | A1 | 1/2019 | Wang et al. | |
| 2019/0030452 | A1 | 1/2019 | Fassbender et al. | |

FOREIGN PATENT DOCUMENTS

| | | | | |
|---|---|---|---|---|
| CN | 206658288 U | 11/2017 | | |
| CN | 206807724 | 12/2017 | | |
| CN | 107948846 | 4/2018 | | |
| CN | 108055609 | 5/2018 | | |
| CN | 108073112 | 5/2018 | | |
| CN | 108093332 | 5/2018 | | |
| CN | 207652608 | 7/2018 | | |
| CN | 207910991 U | 9/2018 | | |
| CN | 109348358 | 2/2019 | | |
| WO | WO-9834698 A2 * | 8/1998 | | G09F 25/00 |
| WO | WO 2017/129349 A1 | 8/2017 | | |

OTHER PUBLICATIONS

Written Opinion dated Jan. 23, 2020 in PCT Application No. PCT/CN2019/112685, filed Oct. 23, 2019.
Chinese Office Action dated Jun. 5, 2019 in Chinese Application No. 201811260256.0 (with Concise English Translation).
Extended European Search Report dated Dec. 1, 2021, in corresponding European Patent Application 19876413.6.

* cited by examiner

LOUDSPEAKER SYSTEM, LOUDSPEAKER, AND LOUDSPEAKER BASE

RELATED APPLICATION

This application is a continuation of International Application No. PCT/CN2019/112685, filed on Oct. 23, 2019, which claims priority to Chinese Patent Application No. 201811260256.0, entitled "LOUDSPEAKER SYSTEM, LOUDSPEAKER, LOUDSPEAKER BASE, AND VOICE PLAYBACK METHOD" filed on Oct. 26, 2018; Chinese Patent Application No. 201822009698.X, entitled "LOUDSPEAKER AND BASE USED IN COOPERATION WITH LOUDSPEAKER" filed on Nov. 30, 2018; Chinese Patent Application No. 201921171443.1, entitled "BASE USED IN COOPERATION WITH TO-BE-DISPLAYED ITEM" filed on Nov. 30, 2018; Chinese Patent Application No. 201921172271.X, entitled "LOUDSPEAKER AND BASE USED IN COOPERATION WITH LOUDSPEAKER" filed on Nov. 30, 2018; and Chinese Patent Application No. 201921277323.X, entitled "SMART PERIPHERAL" filed on Aug. 6, 2019. The entire contents of the prior applications are hereby incorporated by reference in their entirety.

FIELD OF THE TECHNOLOGY

This application relates to the field of electronic devices including a loudspeaker system, a loudspeaker, and a loudspeaker base.

BACKGROUND OF THE DISCLOSURE

With the development of electronic devices, there are more and more smart peripherals, for example, a smart loudspeaker, a speaker, and a smart camera. Most smart loudspeakers in the related art have an integrated body structure. For this reason, a smart loudspeaker in the related art has low extensibility and limited scenarios.

SUMMARY

In exemplary aspects, a loudspeaker system includes a loudspeaker base and a loudspeaker peripheral that is independent of the loudspeaker base. The loudspeaker peripheral is shaped as a role figure. The loudspeaker base and the loudspeaker peripheral connect through a contact connection or a non-contact connection, and provide personalized voice data corresponding to the role figure when connected.

In exemplary aspects, a loudspeaker peripheral is shaped as a role figure. The loudspeaker peripheral includes an electronic identifier of the role figure and circuitry that connects, via a contact connection or a non-contact connection, to a loudspeaker base. The circuitry enables the loudspeaker base to provide personalized voice data corresponding to the role figure when connected to the loudspeaker base.

In exemplary aspects, a loudspeaker base includes communication circuitry that connects to a network and processing circuitry connected to the communication circuitry. The processing circuitry connects, via a contact connection or a non-contact connection, to a loudspeaker peripheral. The loudspeaker peripheral is shaped as a role figure. One of the loudspeaker base and the loudspeaker peripheral being provided with a speaker. The processing circuitry of the loudspeaker base provides personalized voice data corresponding to the role figure when connected to the loudspeaker peripheral.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

To make the objectives, technical solutions, and advantages of this application clearer, the following further describes exemplary embodiments of the present disclosure in detail with reference to the accompanying drawings.

Figure 1:
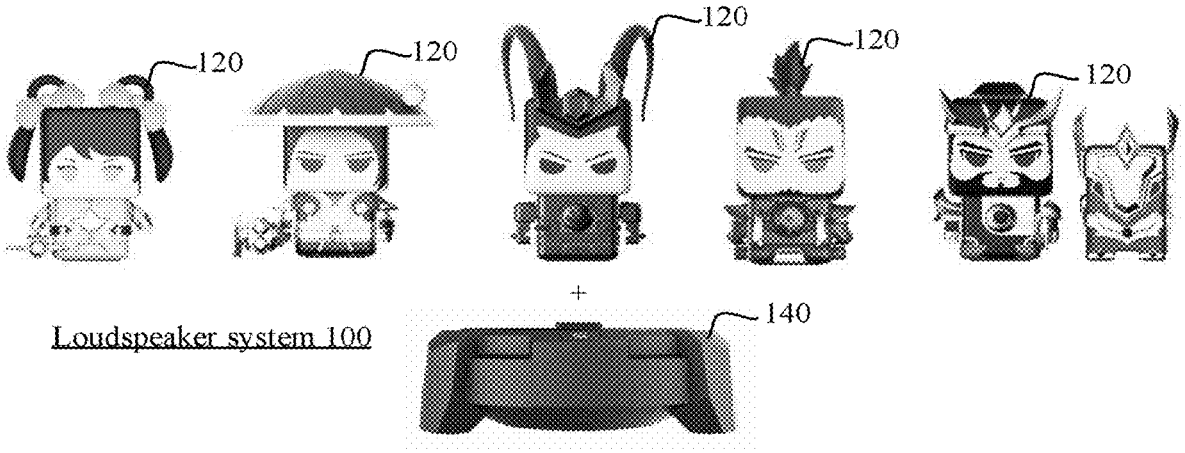
FIG. 1 is a schematic diagram of the appearance of a loudspeaker system according to an exemplary embodiment of the present disclosure.

FIG. 1 is a structural block diagram of a loudspeaker system 100 according to an exemplary embodiment of the present disclosure. The loudspeaker system 100 includes a loudspeaker peripheral 120 and a loudspeaker base 140.

Optionally, there is a plurality of loudspeaker peripherals 120. Each loudspeaker peripheral 120 has a corresponding role figure (also referred to as a role appearance, or role character). The role figure may be at least one of a human role figure, an animal role figure, a plant role figure, a comic role figure, and a game role figure. Optionally, at least two loudspeaker peripherals 120 have different role figures. That is, role figures of two different loudspeaker peripherals 120 may be the same or may be different.

The loudspeaker peripheral 120 and the loudspeaker base 140 are in a contact connection or a non-contact connection. The loudspeaker peripheral 120 and the loudspeaker base 140 are configured to provide personalized voice data corresponding to a role figure in a connected state.

The personalized voice data corresponding to the role figure includes at least one of weather, alarm, music, news, FM broadcasting, and human-computer conversation. The personalized voice data corresponding to the role figure is implemented according to voice data corresponding to the role figure. The voice data includes at least one of an audio recording corpus, text to speech (TTS) synthesis elements, and emotionalized corpus features.

In exemplary embodiments, the loudspeaker base 140 includes a processor and a communication module that is connected to the processor and is used for network connection. At least one of the loudspeaker base 140 and the loudspeaker peripheral 120 is provided with a speaker. The loudspeaker base 140 further includes a microphone assembly connected to the processor.

The loudspeaker peripheral 120 is provided with an electronic component configured to recognize the role figure. The electronic component may be a Bluetooth module, a chip or a memory. The Bluetooth module or the chip stores electronic identification information of the role figure. Schematically, the electronic identification information is a role identifier (ID) of the role figure. The electronic identification information is stored in the Bluetooth module, the chip or the memory in the loudspeaker peripheral 120 to be read and recognized by the processor in the loudspeaker base 140.

Usually, the loudspeaker peripheral 120 is provided with a speaker. However, in exemplary embodiments, if the loudspeaker base 140 is provided with a speaker, the loudspeaker peripheral 120 may not be provided with a speaker.

The loudspeaker base 140 is further provided with an adapter. The loudspeaker base is connected to the loudspeaker peripheral 120 by the adapter. The adapter includes a physical interface or a wireless connection component. The wireless connection component may be a Bluetooth component.

In exemplary embodiments, the loudspeaker base 140 further includes a first rotation mechanism. The first rotation mechanism being configured to drive the loudspeaker peripheral 120 in a contact connection with the loudspeaker base 140 to rotate.

In exemplary embodiments, the first rotation mechanism is configured to drive, in a case that the microphone assembly in the loudspeaker base 140 receives a voice signal, the role figure on the loudspeaker peripheral 120 to move toward a sound source location of the voice signal.

In exemplary embodiments, a second rotation mechanism is disposed in the loudspeaker peripheral 120, the second rotation mechanism being configured to drive the loudspeaker to rotate.

In exemplary embodiments, the loudspeaker peripheral 120 is disposed on the loudspeaker base. Alternatively, the loudspeaker peripheral 120 is disposed next to the loudspeaker base. Alternatively, the loudspeaker peripheral 120 is disposed under the loudspeaker base. Alternatively, the loudspeaker peripheral 120 is remotely connected to the loudspeaker base 140.

In exemplary embodiments, the loudspeaker peripheral 120 is disposed on the loudspeaker base.

The bottom of the loudspeaker peripheral 120 is provided with an insertion member, the top of the loudspeaker base is provided with a limit groove. The loudspeaker is inserted into the limit groove through the insertion member.

In exemplary embodiments, the loudspeaker peripheral 120 is disposed under the loudspeaker base 140.

The top of the loudspeaker peripheral 120 is provided with an insertion member. The bottom of the loudspeaker base 140 is provided with a limit groove. The loudspeaker peripheral 120 is inserted into the limit groove through the insertion member.

In exemplary embodiments, magnetic parts with corresponding locations are disposed between the loudspeaker peripheral 120 and the loudspeaker base 140.

Thus, according to the loudspeaker system provided in this exemplary embodiment, a smart loudspeaker is divided into a loudspeaker peripheral and a loudspeaker base. There is a plurality of replaceable loudspeaker peripherals, and each loudspeaker peripheral has a role figure. When the loudspeaker peripheral 120 and the loudspeaker base 140 are in a connected state, personalized voice data corresponding to the role figure is provided, so that a loudspeaker system may provide different types of personalized voice data for different role figures, and the loudspeaker peripheral 120 or the loudspeaker base 140 may provide personalized voice data separately, thereby achieving relatively high extensibility and practicality.

Figure 2:
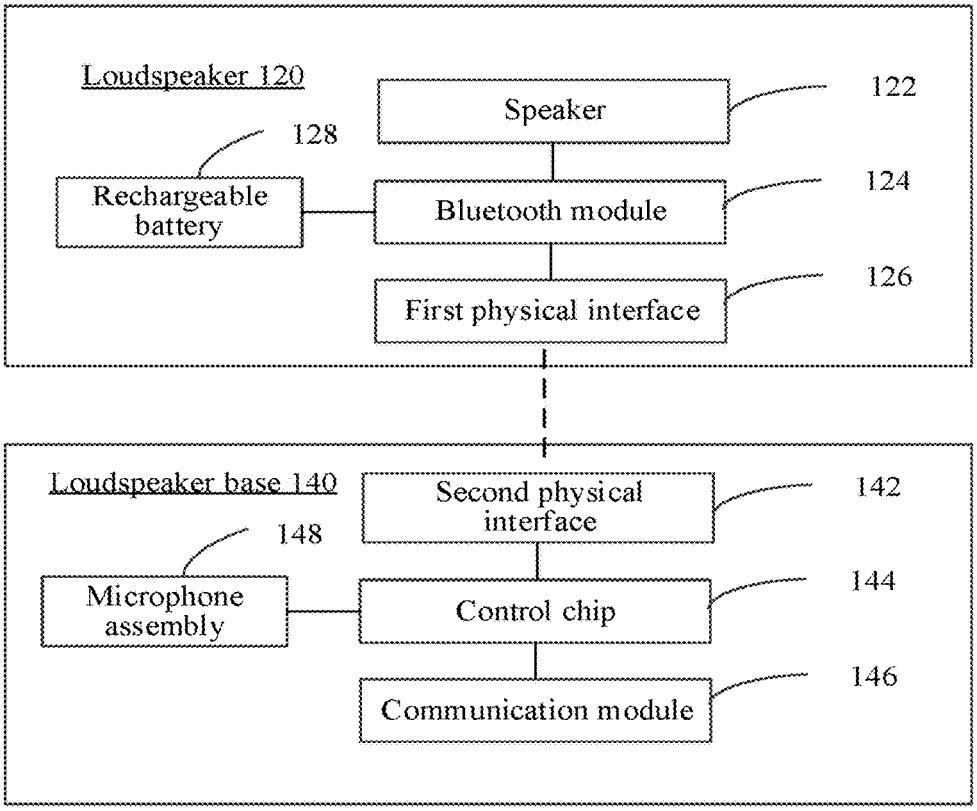
FIG. 2 is a schematic structural diagram of a loudspeaker system according to an exemplary embodiment of the present disclosure.

FIG. 2 is a structural block diagram of a loudspeaker system according to an exemplary embodiment of the present disclosure. The loudspeaker peripheral 120 includes a speaker 122, a Bluetooth module 124, a first physical interface 126, and a rechargeable battery 128. These modules and components of the loudspeaker peripheral 120 may be implemented by circuitry, for example.

The speaker 122 is electrically connected to the Bluetooth module 124. The Bluetooth module 124 is electrically connected to the first physical interface 126. The rechargeable battery 128 is electrically connected to all the speaker 122, the Bluetooth module 124, and first physical interface 126.

The loudspeaker base 140 includes a second physical interface 142, a control chip 144, a communication module 146, and a microphone assembly 148, all of which may be implemented by circuitry.

The second physical interface 142 is electrically connected to the control chip 144. The control chip 144 is further electrically connected to the communication module 146 and the microphone assembly 148. The communication module 146 may also include a network module that connects to a network.

The first physical interface 126 and the second physical interface 142 are physical interfaces that match each other. For example, the first physical interface 126 is a female interface, and the second physical interface 142 is a male interface. In another example, the first physical interface 126 is a male interface, and the second physical interface 142 is a female interface.

Thus, according to the loudspeaker system provided in this exemplary embodiment, a smart loudspeaker is divided into a loudspeaker peripheral and a loudspeaker base. A speaker and a Bluetooth module are disposed in the loudspeaker peripheral, and a control chip used for providing artificial intelligence (AI) feedback is disposed in the loudspeaker base. When the loudspeaker peripheral and the loudspeaker base are in a combined form, a smart loudspeaker that can provide AI feedback is formed. When the loudspeaker peripheral and the loudspeaker base are in a separate form, the loudspeaker peripheral may be alternatively used as a Bluetooth loudspeaker separately. A smart loudspeaker in a combined form is relatively heavy and suitable for use at home, and a loudspeaker in a separate form is relatively light and suitable for use outdoors. Therefore, the problem of poor portability caused by a relatively heavy smart loudspeaker in the related art is resolved.

Figure 3:
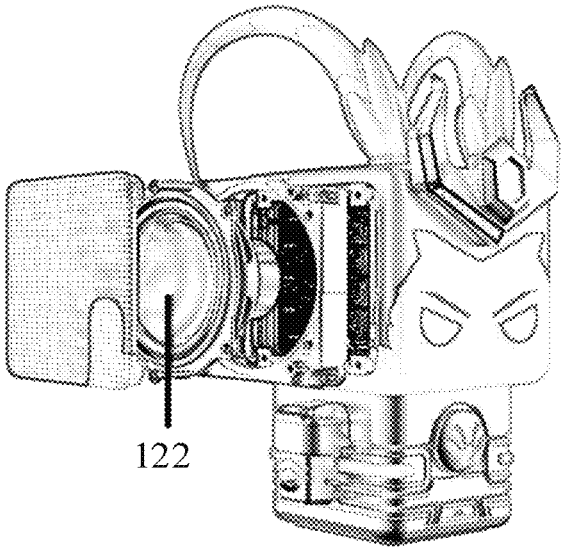
FIG. 3 is a schematic diagram of the detachment of a loudspeaker at an angle of view according to an exemplary embodiment of the present disclosure.
Figure 4:
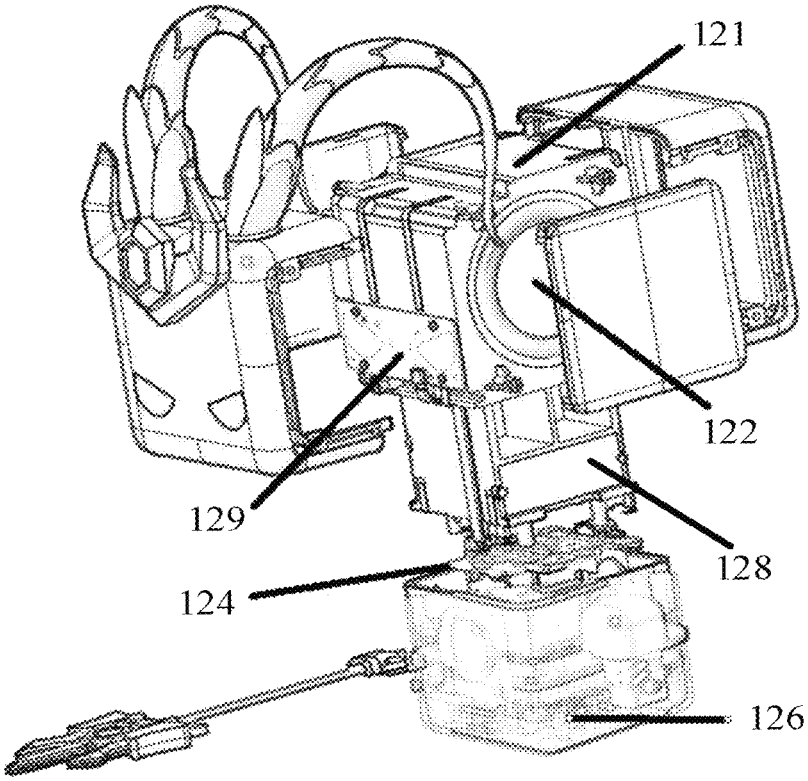
FIG. 4 is a schematic diagram of the detachment of a loudspeaker at another angle of view according to an exemplary embodiment of the present disclosure.

FIG. 3 and FIG. 4 are schematic diagrams of the detachment of a loudspeaker peripheral 120 according to an exemplary embodiment of the present disclosure, respectively. The loudspeaker peripheral 120 includes a loudspeaker body 121 and a speaker 122, a first Bluetooth module 124, a first physical interface 126, and a rechargeable battery 128 that are located in the loudspeaker body 121, all of which may be implemented by circuitry.

The loudspeaker body 121 has a corresponding role figure. The role figure may be at least one of a human role figure, an animal role figure, a plant role figure, a comic role figure, and a game role figure. For example, the role figure is a character role such as "Lu Bu," "Sun Shangxiang," "Liu Bei," and "Guan Yu" in a cartoon form. In this exemplary embodiment, an example in which the loudspeaker body 121 has a human role figure of Lu Bu in a cartoon form is used for description.

The speaker 122 is disposed at a head location of the loudspeaker body 121. The head location forms a loudspeaker cavity of the speaker 122. Optionally, the speaker 122 has two diaphragms. The two diaphragms are disposed at a left ear location and a right ear location of a human head location respectively. The speaker 122 is electrically connected to the first Bluetooth module 124.

The first Bluetooth module 124 is disposed at a waist location of the loudspeaker body 121. The waist location is provided with a Bluetooth module control circuit board. The first Bluetooth module 124 is disposed on the Bluetooth module control circuit board. The first Bluetooth module 124 is electrically connected to the first physical interface 126.

The rechargeable battery 128 is electrically connected to the speaker 122, the first Bluetooth module 124, and the first physical interface 126.

The first physical interface 126 is a physical interface matching the second physical interface 142. The second physical interface 142 is a physical interface that is disposed on the loudspeaker base 140 and is configured to transmit a first voice signal. The first voice signal is a first voice signal for providing AI feedback on an input voice.

Figure 5:
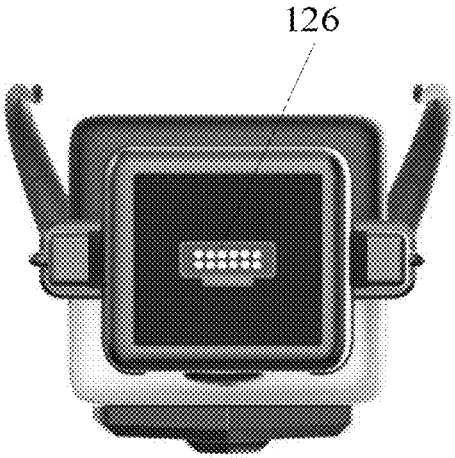
FIG. 5 is a schematic view of the bottom surface of a loudspeaker according to an exemplary embodiment of the present disclosure.

Optionally, as shown in FIG. 5, the first physical interface 126 is disposed at a foot location of the loudspeaker body 121, for example, a central bottom location of the foot location. The first physical interface 126 may be a pogo pin connector. The pogo pin connector has a power terminal, a data terminal, and a ground terminal. In another embodiment, the first physical interface 126 is a board to board (B2B) interface.

Optionally, the foot location of the loudspeaker body 121 is provided with a Type-C interface. The Type-C interface is connected to the rechargeable battery, and is configured to charge the rechargeable battery in the loudspeaker peripheral 120 in a separate form.

The loudspeaker peripheral 120 is configured to receive, in a combined form, the first voice signal through the first physical interface 126 for playing, and receive, in a separate form, a second voice signal through the first Bluetooth module 124 for playing. The combined form is a state that the loudspeaker peripheral 120 is connected to the loudspeaker base 140 by the first physical interface 126 and the second physical interface 142.

Optionally, in the separate form, the loudspeaker peripheral 120 may be in a Bluetooth connection with the loudspeaker base 140, or may be in a Bluetooth connection with a smartphone (or another terminal having a Bluetooth connection capability). That is, the second voice signal may be generated by the loudspeaker base 140 or may be generated by the smartphone.

Optionally, the loudspeaker peripheral 120 further includes a first signal light component 129 disposed at an eye part of the role figure.

The first signal light component 129 is electrically connected to the first Bluetooth module 124. The first signal light component 129 is configured to display a first light signal when the first Bluetooth module 124 performs Bluetooth pairing. For example, the first signal light component 129 displays a light signal that flashes intermittently during Bluetooth pairing.

Thus, according to the loudspeaker peripheral provided in this exemplary embodiment, a Bluetooth module, a rechargeable battery, and a speaker are disposed in a loudspeaker body, thereby implementing an independent Bluetooth loudspeaker function. When the loudspeaker peripheral is carried by a user for use outdoors, the loudspeaker peripheral may establish a Bluetooth connection with a terminal such as a smartphone or a tablet computer to be used as a conventional Bluetooth loudspeaker.

According to the loudspeaker peripheral provided in this embodiment, a personalized role figure is set to ensure that different loudspeakers have different personalized figures, and the user may separately collect, purchase or use a loudspeaker peripheral with a personalized figure according to their preferences.

Figure 6:
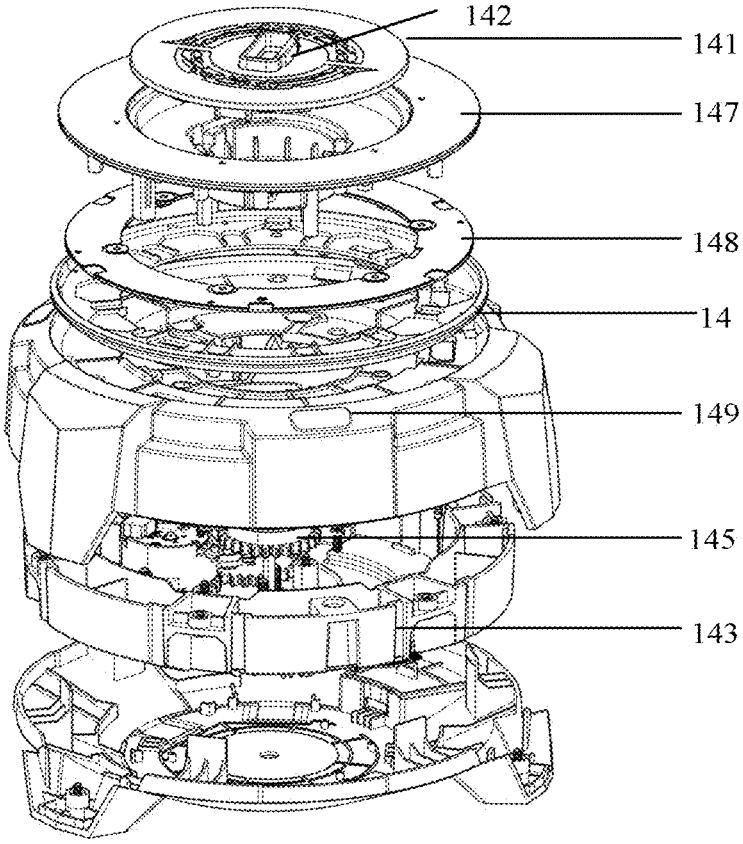
FIG. 6 is a schematic exploded view of a loudspeaker base at an angle of view according to an exemplary embodiment of the present disclosure.
Figure 7:
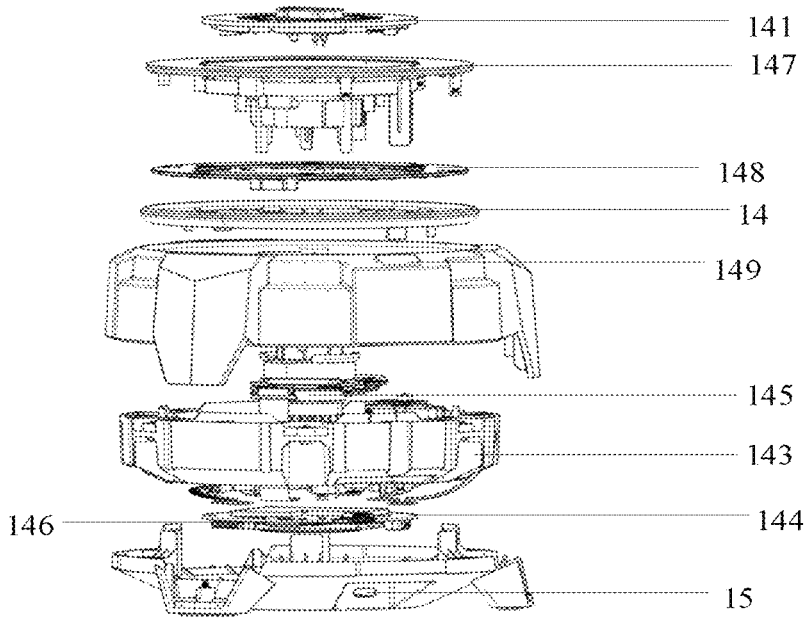
FIG. 7 is a schematic exploded view of a loudspeaker base at another angle of view according to an exemplary embodiment of the present disclosure.

FIG. 6 and FIG. 7 are schematic exploded views of a loudspeaker base 140 according to an exemplary embodiment of this application respectively. The loudspeaker base 140 includes a second physical interface 142, a control chip 144, a communication module 146, and a microphone assembly 148.

Figure 8:
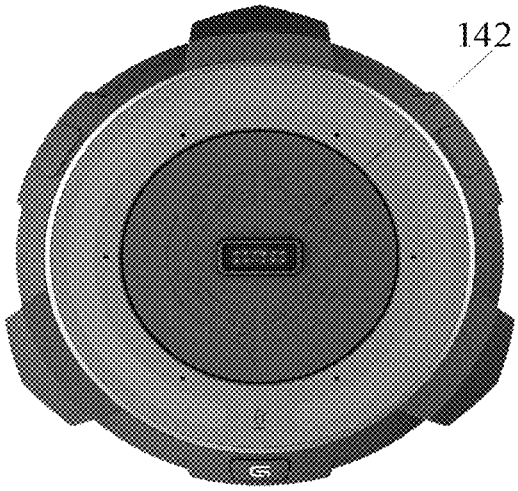
FIG. 8 is a schematic view of the top face of a loudspeaker base according to an exemplary embodiment of the present disclosure.

The second physical interface 142 is a physical interface corresponding to the first physical interface 126. As shown in FIG. 8, the second physical interface 142 is disposed at a central top location of the loudspeaker base 140. The second physical interface 126 may be a pogo pin connector. The pogo pin connector has a power terminal, a data terminal, and a ground terminal. In another exemplary embodiment, the second physical interface 142 may a B2B interface. The second physical interface 142 is electrically connected to the control chip 144. Optionally, the second physical interface 142 and the first physical interface 126 may further be separately provided with a magnet to facilitate an attraction and connection between the second physical interface 142 and the first physical interface 126 in the combined form.

The control chip 144 may be a system on chip (SOC). Optionally, the communication module 146 is a wireless communication module or a wired communication module. The wireless communication module may be a Wi-Fi communication module. The wired communication module may be an RJ-45 module. An example in which the communication module 146 is a Wi-Fi communication module is used for description in this exemplary embodiment. Optionally, the control chip 144 and the communication module 146 may be disposed on the same main control circuit board.

The control chip 144 may further be connected to the communication module 146 and the microphone assembly 148. Optionally, the microphone assembly 148 is a microphone array. When the loudspeaker base 140 is a circular base, the microphone array may be arranged in a ring. When the loudspeaker base 140 is a triangular base, the microphone array may be arranged according to each angle of the triangle. When the loudspeaker base 140 is a polygonal base, the microphone array may be arranged according to each side of the polygon.

Optionally, the loudspeaker base 140 further includes a base plane 141, a base outer frame 143, and a drive component 145. The second physical interface 142 is disposed at a central location of the base plane 141. The drive component 145 includes a motor and a gear set. The gear set is connected to the base plane 141. When the motor rotates, the gear set drives the base plane 141 to rotate, so as to ensure a loudspeaker peripheral located on the base plane 141 to face different locations. Optionally, the base plane 141 is a circular base plane. The drive component 145 may also be referred to as a first rotation mechanism. Optionally, the drive component 145 is configured to drive, in a case that a microphone assembly in the loudspeaker base 140 receives a voice signal, a role figure on the loudspeaker peripheral 120 to move toward a sound source location of the voice signal.

Optionally, the loudspeaker base 140 further includes a touch region 147. The control chip 144 is further connected to the annular touch region 147. The touch region 147 is configured to control the volume. The touch region may be at least one shape of a strip, a ring, and a circle. When the touch region is set to a strip, the volume is turned up during a swipe touch in a first length direction of the strip, and the volume is turned down during a swipe touch in a second length direction of the strip. When the touch region is set to a ring or a circle, the volume is turned up during a swipe touch in a first circumferential direction of the ring, and the volume is turned down during a swipe touch in a second circumferential direction of the ring.

Optionally, the loudspeaker base 140 further includes a second signal light component 14. The second signal light component 14 is electrically connected to the control chip 144. The second signal light component 14 may be set to a ring and is inserted below the annular touch region 147.

Optionally, the loudspeaker base 140 further includes a physical button 149. The physical button 149 is electrically connected to the control chip 144.

Optionally, the loudspeaker base 140 further includes a power interface 15 electrically connected to the control chip 144. The power interface may be a Type-C interface.

In an exemplary embodiment, the control chip 144 is configured to acquire, in a combined form, an input voice through the microphone assembly 148, obtain, through the communication module 146, a first voice signal for providing AI feedback on the input voice, and output the first voice signal to the loudspeaker peripheral 120 through the second physical interface 142. The second physical interface 142 is a physical interface matching the first physical interface 126 on the loudspeaker peripheral 120.

In an exemplary embodiment, the loudspeaker base 14 further includes a second Bluetooth module (not shown in the figure). The second Bluetooth module may be disposed on the main control circuit board, and the control chip 144 may further be connected to the second Bluetooth module. The control chip 144 is configured to acquire an input voice through the microphone assembly 148 in a separate form, obtain, through the communication module 146, a second voice signal for providing AI feedback on the input voice, and output the second voice signal to the loudspeaker peripheral 120 through a Bluetooth connection.

The Bluetooth connection is a connection between the first Bluetooth module and the second Bluetooth module.

In an exemplary embodiment, the control chip 144 is configured to obtain a user account during network configuration, obtain, through the communication module 146, a third voice signal for providing AI strategy feedback in a battle in a case that the user account is in an online game state, and output the third voice signal to the loudspeaker through the second physical interface.

In an exemplary embodiment, the microphone assembly 148 is an array microphone. The control chip 144 is configured to determine, in a combined form and according to an input voice acquired by the array microphone 148, a sound source location corresponding to the input voice, and control, through the drive component 145, the loudspeaker located on the base plane to face the sound source location.

In an exemplary embodiment, the control chip 144 is configured to receive a touch signal on the annular touch region, and adjust the volume of the loudspeaker according to the touch signal.

In an exemplary embodiment, the control chip 144 is configured to switch from a sleep state to an awake state when receiving a first press signal through the physical button 149, and/or, enter a game AI mode when receiving a second press signal through the physical button 149. The control chip 144 may also enter a network configuration function when receiving a third press signal through the physical button 149. The game AI mode is a mode of providing AI strategy feedback in a battle in a case that the user account is in an online game state.

In an exemplary embodiment, the control chip 144 is configured to display a second light signal when the second physical interface 142 outputs the voice signal.

In an exemplary embodiment, the control chip 144 is configured to obtain a role ID of the role figure corresponding to the loudspeaker peripheral 120, obtain voice data corresponding to the role ID, the voice data including at least one of an audio recording corpus, TTS synthesis elements, and emotionalized corpus features, and output a voice signal having a timbre corresponding to the role ID to the loudspeaker peripheral 120 through the second physical interface 142 according to the voice data corresponding to the role ID. The voice signal includes at least one of the first voice signal, the second voice signal, and the third voice signal. The role ID may be stored in the Bluetooth module, the chip or the memory of the loudspeaker peripheral.

Thus, according to the loudspeaker base provided in this exemplary embodiment, a control chip is disposed in the base, and when the loudspeaker base and the loudspeaker are in a combined form, a complete smart loudspeaker function can be implemented. Because the loudspeaker further has a personalized role figure, when a corresponding AI feedback function of a backend server is provided together, the loudspeaker may be used as a smart robot platform.

The loudspeaker base according to this embodiment can implement an AI voice feedback function at a user level or an AI strategy analysis function in a battle for a game application (APP). When implementing the AI strategy analysis function in a battle, because the role figure on the loudspeaker peripheral is the same as the appearance of a game role in a game, the online user experience and offline user experience become consistent by using AI capability.

The loudspeaker base according to this embodiment can further implement sound source positioning by using an array microphone, and control the loudspeaker located on the base to face the sound source direction, so as to improve the intelligence level of the smart loudspeaker during use as a smart robot and implement sound position discrimination.

According to the loudspeaker base provided in this embodiment, a role ID corresponding to the loudspeaker peripheral can be used to obtain personalized voice data corresponding to the role ID, to use a personalized service of the personalized voice data in at least one aspect of a timber aspect, a corpus aspect, and a tone and mood aspect.

The loudspeaker peripheral and the loudspeaker base may work in two forms, namely, a combined form and a separate form. The following describes a work procedure of the loudspeaker system during voice playback in combination with different forms.

Figure 9:
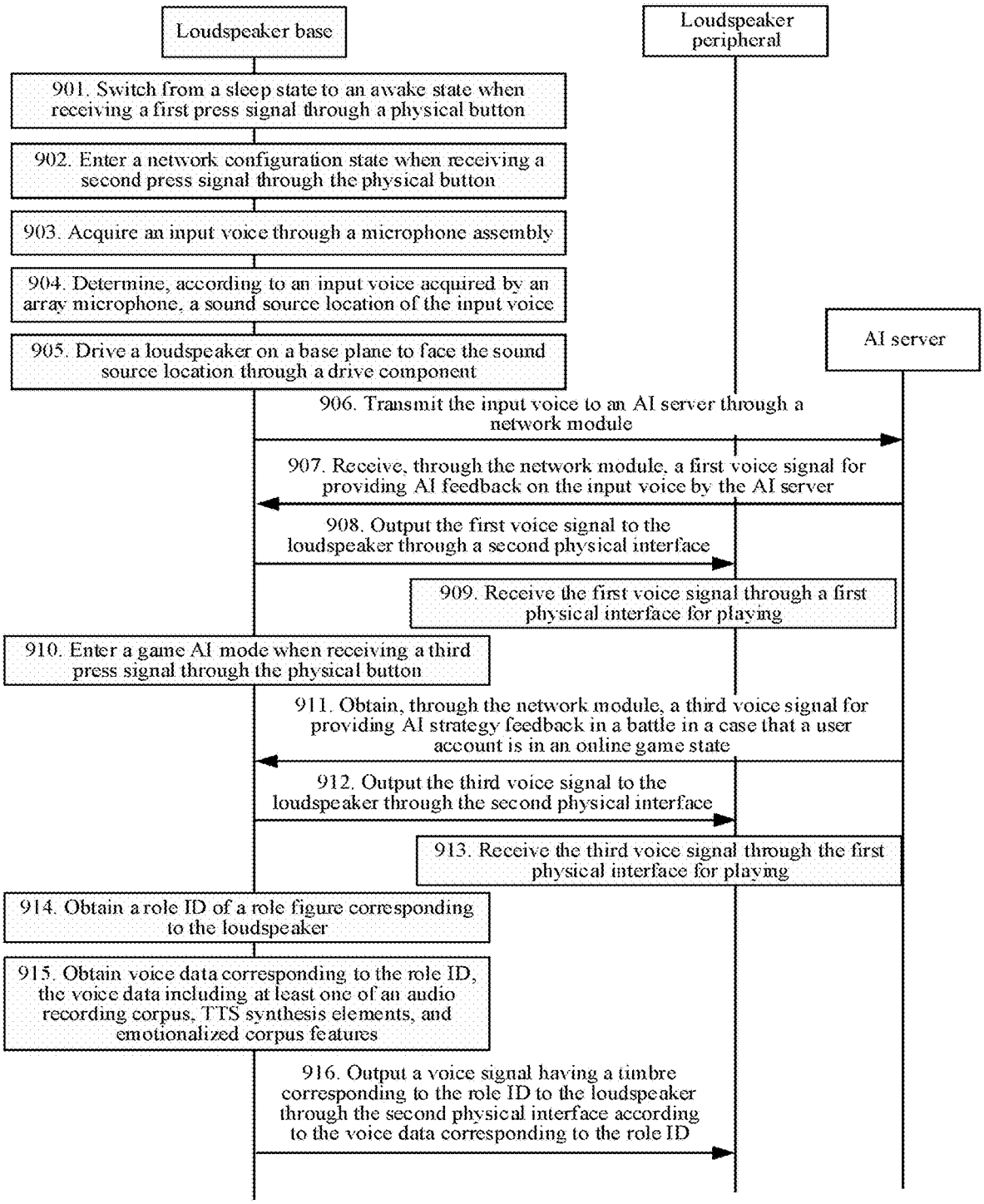
FIG. 9 is a flowchart of a voice playback method according to an exemplary embodiment of the present disclosure.

FIG. 9 is a flowchart of a voice playback method of a loudspeaker system in a combined form according to an exemplary embodiment of the present disclosure. The voice playback method may be applied to the loudspeaker system shown in FIG. 1 to FIG. 8. The method includes the following steps.

In step 901, a loudspeaker base switches from a sleep state to an awake state when receiving a first press signal through a physical button. The physical button may have a name, for example, a G button, a super button, and a smart button. The first press signal may be a single press signal. After being connected to power, the loudspeaker base is in the sleep state. A user applies the first press signal to the physical button. A control chip then switches from the sleep state to the awake state when receiving the first press signal through the physical button. The awake state is a state of monitoring the user's input voice.

In step 902, the loudspeaker base enters a network configuration state when receiving a second press signal through the physical button. The second press signal may be a long press signal lasting n seconds. The loudspeaker base needs to be connected to an AI server on the Internet when being in an AI working state. If the network module of the loudspeaker base is a Wi-Fi communication module, the loudspeaker base needs to enter the network configuration state during initial use.

In the network configuration state, the loudspeaker base is connected to a smartphone through the Wi-Fi communication module. A user inputs Wi-Fi access information in a current environment into the loudspeaker base through the smartphone. The Wi-Fi access information includes a service set identifier (SSID) and an access password. The loudspeaker base is then disconnected from the smartphone, and is connected to a wireless access point through the Wi-Fi access information to access the Internet to communicate with the AI server.

Optionally, if an APP (for example, a game APP) corresponding to the role figure is run on the smartphone, the loudspeaker base further obtains and caches a user account on the smartphone in the network configuration state. The user account is used for uniquely identifying the identity of the user in the APP.

In step 903, the loudspeaker base acquires an input voice through a microphone assembly. The loudspeaker base acquires an input voice of the user through a microphone assembly in the awake state.

In step 904, the loudspeaker base determines, according to an input voice acquired by an array microphone, a sound source location of the input voice. When the microphone assembly is an array microphone, the control chip locates the sound source location of the input voice according to receiving moments of input voices acquired by different microphones on the array microphone. Optionally, the plane of the base of the loudspeaker base is divided into n locations, n being a divisor of 360 degrees. The control chip determines that the sound source location corresponding to the input voice is one of the n locations.

In step 905, the loudspeaker base drives a loudspeaker on a base plane to face the sound source location through a drive component. The control chip drives, through the drive component, the loudspeaker on the base plane to face the sound source location. Optionally, the control chip stores a current facing location of the base plane, and the control chip determines a target facing location of the base plane according to the sound source location, controls the number of revolutions and rotational direction of a motor in the drive component according to the current facing location and the target facing location, and controls the drive component to rotate according to the number of revolutions and rotational direction of the motor.

In step 906, the loudspeaker base transmits the input voice to an AI server through a network module. The loudspeaker base further transmits the input voice to the AI server. The AI server performs speech-to-text (STT) conversion on the input voice, then extracts a keyword in a word sequence obtained through conversion, and generates, according to the keyword, a first voice signal for providing AI feedback.

Optionally, the AI feedback is a capability of providing AI voice feedback based on a vertical field. The vertical field includes at least one of weather, alarm, chat, music, news, and FM broadcasting.

Figure 10:
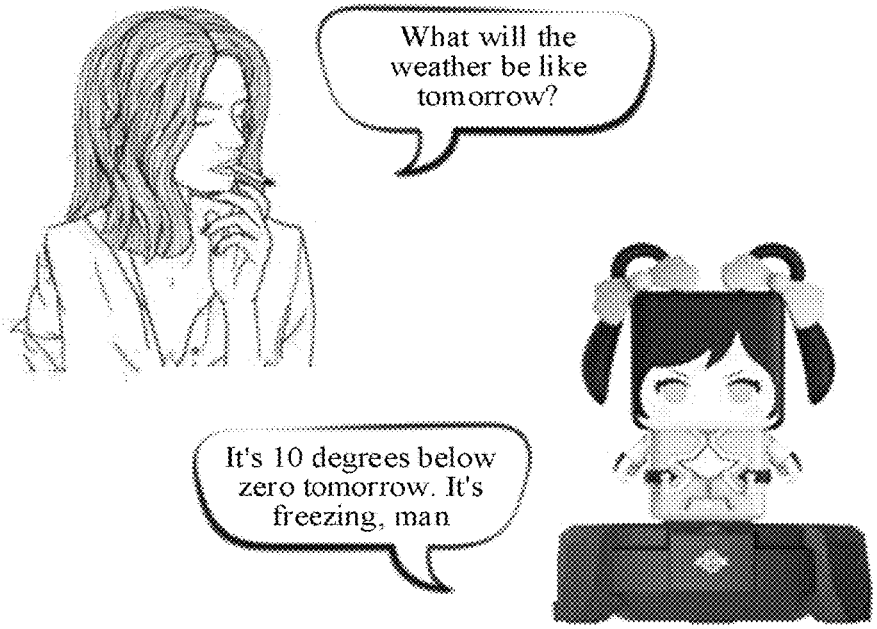
FIG. 10 is a diagram of an application scenario of a loudspeaker system according to an exemplary embodiment of the present disclosure.

For example, as shown in FIG. 10, the user may make a voice inquiry "What will the weather be like tomorrow?" to the loudspeaker base. After the loudspeaker base transmits the input voice to the AI server, the AI server generates a first voice signal "It's 10 degrees below zero tomorrow. It's freezing, man."

In step 907, the loudspeaker base receives, through the network module, a first voice signal for providing AI feedback on the input voice by the AI server. Optionally, the first voice signal is a signal in a voice form. Alternatively, the first voice signal is a signal in a text form. The loudspeaker base then performs TTS according to the signal in a text form to obtain a first voice signal in a voice form.

In step 908, the loudspeaker base outputs the first voice signal to the loudspeaker through a second physical interface. The control chip outputs the first voice signal to the loudspeaker through a data terminal in the second physical interface.

In step 909, the loudspeaker receives the first voice signal through a first physical interface for playing. The loudspeaker receives the first voice signal through a data terminal in the first physical interface for playing.

In step 910, the loudspeaker base enters a game AI mode when receiving a third press signal through the physical button. The third press signal may be a double-tap signal.

The third press signal may be a double-tap signal. Optionally, the game AI mode is a mode that a game server provides AI strategy information to the loudspeaker system when the user runs a game APP corresponding to the role figure on a terminal.

Optionally, the loudspeaker base stores a user account on the smartphone in a network configuration stage. The user account is used for identifying the identity of the user in the APP. The APP may be a game APP corresponding to a role figure. For example, the APP is a multiplayer online battle arena (MOBA) game. The user account is an account of the user in the MOBA game. The role figure is a game role operated by the user in the MOBA game.

In step 911, the loudspeaker base obtains, through the network module, a third voice signal for providing AI strategy feedback in a battle in a case that a user account is in an online game state. When the user uses a smartphone (or a computer) to run an APP corresponding to a role figure, the APP transmits real-time running data to a backend server. The backend server generates a third voice signal for AI strategy feedback in a battle according to an AI strategy.

Figure 11:
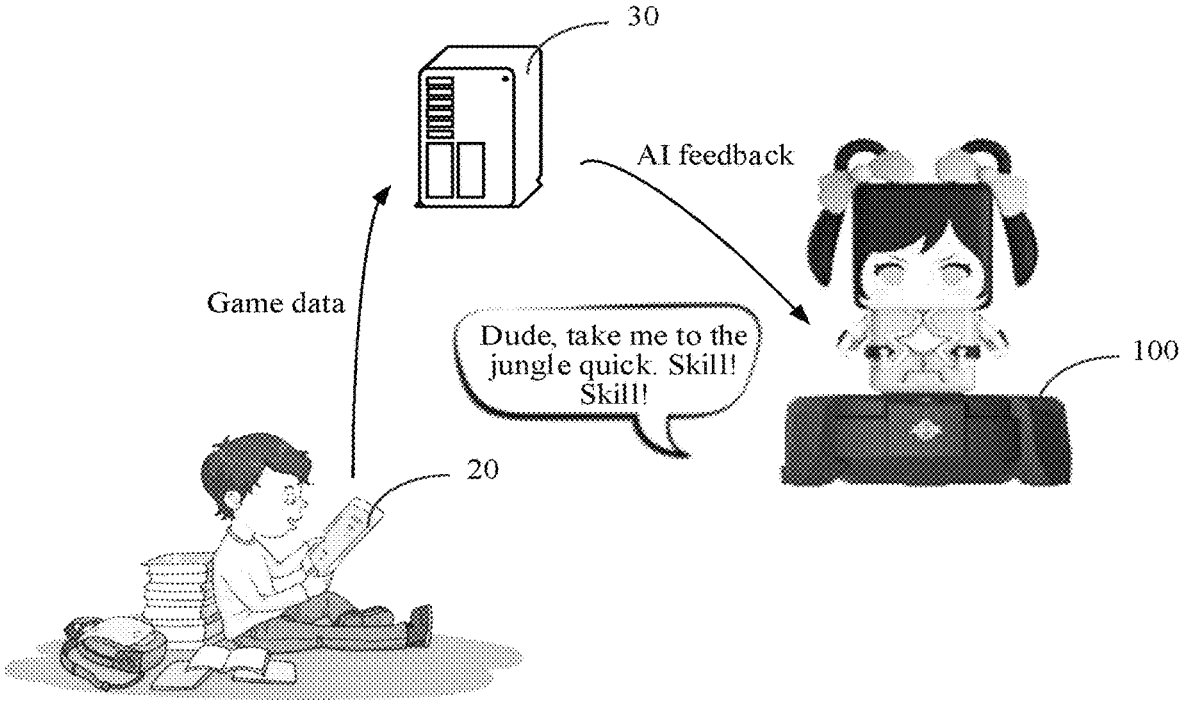
FIG. 11 is a diagram of an application scenario of a loudspeaker system according to another exemplary embodiment of the present disclosure.

An example in which the APP is a MOBA game is used. When the user operates the game role for game, a smartphone 20 uploads game data to a backend server 30. The backend server 30 analyzes the game data to determine that at present a better game strategy for the game role is to go to the jungle. The backend server 30 then transmits a third voice signal for providing AI strategy feedback in a battle to the loudspeaker system 100. Schematically, as shown in FIG. 11, the third voice signal is "Dude, take me to the jungle quick. Skill! Skill!"

In step 912, the loudspeaker base outputs the third voice signal to the loudspeaker through the second physical interface. The control chip outputs the third voice signal to the loudspeaker through the data terminal in the second physical interface.

In step 913, a loudspeaker peripheral receives the third voice signal through the first physical interface for playing. The loudspeaker peripheral receives the third voice signal through the data terminal in the first physical interface for playing.

In step 914, the loudspeaker base obtains a role ID of a role figure corresponding to the loudspeaker. Because each loudspeaker peripheral has a corresponding role figure, a Bluetooth chip of the loudspeaker peripheral may store a role ID corresponding to the loudspeaker peripheral. The role ID is electronic identification information of the role figure.

The loudspeaker base obtains the role ID of the role figure corresponding to the loudspeaker peripheral through the data terminal in the second physical interface. The role ID may be stored in the Bluetooth module, the chip or the memory of the loudspeaker peripheral.

In step 915, the loudspeaker base obtains voice data corresponding to the role ID. The voice data includes at least one of an audio recording corpus, TTS synthesis elements, and emotionalized corpus features.

In an exemplary embodiment, the loudspeaker base stores voice data corresponding to each role ID. The loudspeaker base obtains corresponding voice data according to the obtained role ID.

In another exemplary embodiment, the backend server stores voice data corresponding to each role ID. The loudspeaker base obtains voice data corresponding to the role ID from the backend server according to the obtained role ID.

In step 916, the loudspeaker base outputs a voice signal having a timbre corresponding to the role ID to the loudspeaker through the second physical interface according to the voice data corresponding to the role ID. Optionally, when the voice data includes an audio recording corpus, the loudspeaker base may randomly or conditionally output a voice signal having a timbre corresponding to the role ID to the loudspeaker. When the voice data includes TTS synthesis elements, the loudspeaker base obtains, in a case of receiving a first voice signal, a second voice signal or a third voice signal in a text form, a first voice signal, a second voice signal or a third voice signal having a personalized timbre through the TTS synthesis elements and through conversion. When the voice data includes the emotionalized corpus features, the loudspeaker base may output a voice signal having a timbre corresponding to the role ID to the loudspeaker according to a mood of the user or a triggering condition in a game program. The voice signal may be at least one of the first voice signal, the second voice signal, and the third voice signal.

Thus, according to the voice playback method provided in this embodiment, a control chip is disposed in the base, and when the loudspeaker base and the loudspeaker are in a combined form, a complete smart loudspeaker function may be implemented. Because the loudspeaker further has a personalized role figure, when a corresponding AI feedback function of a backend server is provided together, the loudspeaker may be used as a smart robot platform.

By using the voice playback method according to this exemplary embodiment, an AI voice feedback function at a user level or an AI strategy analysis function in a battle for a game APP can be implemented. When implementing the AI strategy analysis function in a battle, because the role figure on the loudspeaker is the same as the appearance of a game role in a game, the online user experience and offline user experience become consistent by using AI capability.

By using the voice playback method according to this exemplary embodiment, sound source positioning can further be implemented by using an array microphone, and the loudspeaker located on the base is controlled to face the sound source direction, so as to improve the intelligence level of the smart loudspeaker during use as a smart robot and implement sound position discrimination.

According to the voice playback method provided in this exemplary embodiment, a role ID corresponding to the loudspeaker peripheral can be used to obtain personalized voice data corresponding to the role ID, to use a personalized service of the personalized voice data in at least one aspect of a timber aspect, a corpus aspect, and a tone and mood aspect.

Figure 12:
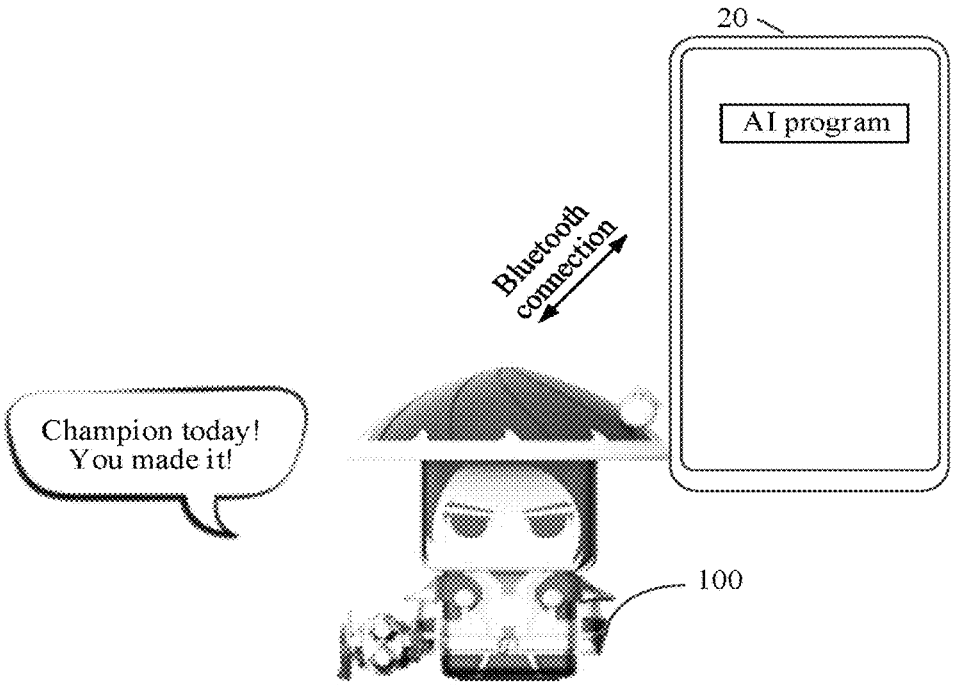
FIG. 12 is a diagram of an application scenario of a loudspeaker system according to another exemplary embodiment of the present disclosure.

In the separate form, the loudspeaker peripheral 120 may establish a Bluetooth connection with the loudspeaker base 140, or the loudspeaker peripheral 120 may establish a Bluetooth connection with the smartphone. The loudspeaker peripheral 120 receives the second voice signal through the Bluetooth connection for playing. In a schematic example shown in FIG. 12, the smartphone 20 is installed with an AI program. The AI program on the smartphone 20 transmits a second voice signal to the loudspeaker peripheral 120 through the Bluetooth connection. The loudspeaker peripheral 120 plays the second voice signal.

Figure 13:
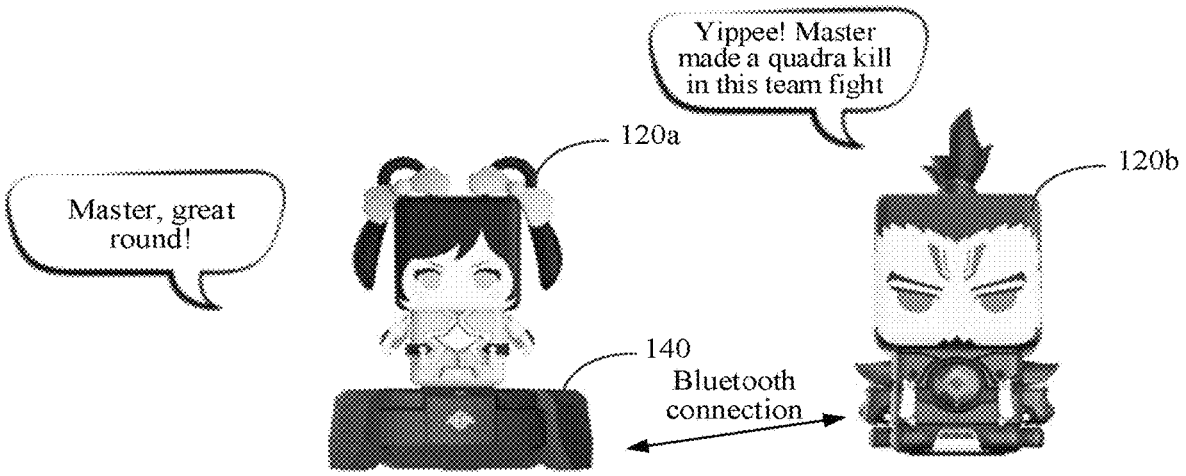
FIG. 13 is a diagram of an application scenario of a loudspeaker system in a first two-unit linkage state according to another exemplary embodiment of the present disclosure.

In another exemplary embodiment shown in FIG. 13, in a first two-unit linkage state, a loudspeaker base 140 forms a combined form with a loudspeaker peripheral 120*a* and forms a separate form with another loudspeaker peripheral 120*b* at the same time, and communicates with the loudspeaker peripheral 120*b* in the separate form through a Bluetooth connection, so that the same loudspeaker base 140 may control both the loudspeaker peripheral 120*a* and the loudspeaker peripheral 120*b* to play voices at the same time. For example, role figures corresponding to the loudspeaker peripheral 120*a* and the loudspeaker peripheral 120*b* are Sun Shangxiang and Zhang Fei respectively. The loudspeaker base 140 then controls the loudspeaker peripheral 120*a* to play a voice "Master, great round!", and later controls the loudspeaker peripheral 120*b* to play a voice "Yippee! Master made a quadra kill in this team fight".

Figure 14:
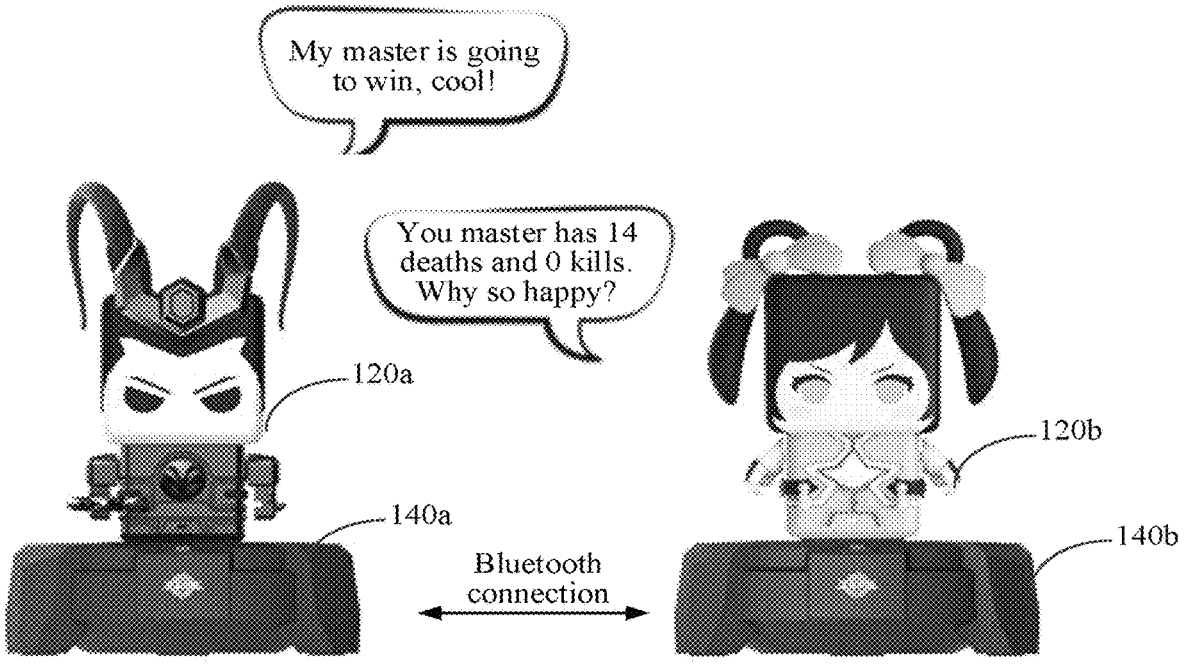
FIG. 14 is a diagram of an application scenario of a loudspeaker system in a second two-unit linkage state according to another exemplary embodiment of the present disclosure.

In another exemplary embodiment shown in FIG. 14, in a second two-unit linkage state, a first loudspeaker base 140*a* forms a combined form with a first loudspeaker peripheral 120*a*, a second loudspeaker base 140*b* forms a combined form with a second loudspeaker peripheral 120*b*, and the first loudspeaker base 140*a* and the second loudspeaker base 140*b* communicate through a Bluetooth connection. For example, role figures corresponding to the loudspeaker peripheral 120*a* and the loudspeaker peripheral 120*b* are Lu Bu and Sun Shangxiang respectively. The loudspeaker base 140*a* then controls the loudspeaker peripheral 120*a* to play a voice "My master is going to win, cool!", and later controls the loudspeaker peripheral 120*b* to play a voice "You master has 14 deaths and 0 kills. Why so happy?"

Figure 15:
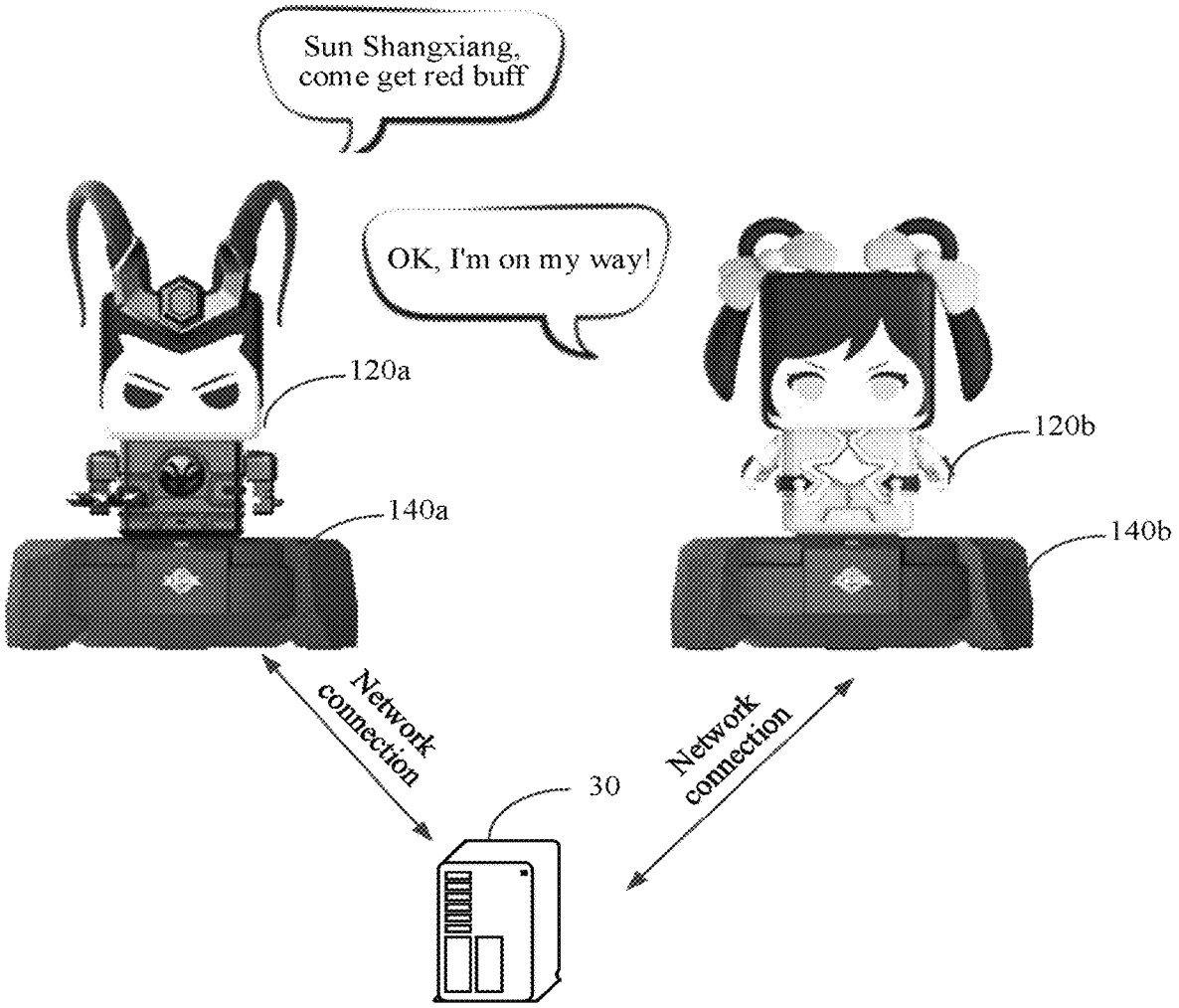
FIG. 15 is a diagram of an application scenario of a loudspeaker system in a second two-unit linkage state according to another exemplary embodiment of the present disclosure.

In another exemplary embodiment shown in FIG. 15, in a second two-unit linkage state, the first loudspeaker base 140*a* may not establish a Bluetooth connection with the second loudspeaker base 140*b*. Instead, the first loudspeaker base 140*a* and the second loudspeaker base 140*b* are controlled by the same AI server 30, so as to implement the foregoing playing method of the two-unit linkage state. For example, role figures corresponding to the loudspeaker peripheral 120*a* and the loudspeaker peripheral 120*b* are Lu Bu and Sun Shangxiang respectively. The AI server 30 then controls the loudspeaker peripheral 120*a* through the loudspeaker base 140*a* to play AI strategy feedback "Sun Shangxiang, come get red buff." in a battle, and later controls the loudspeaker peripheral 120*b* through the loudspeaker base 140*b* to play a voice "OK, I'm on my way!" when detecting that the game role Sun Shangxiang moves toward a jungle monster corresponding to the red Buff.

Thus, according to the loudspeaker system provided in this exemplary embodiment, users' use scenarios of a smart loudspeaker can be effectively extended (that is, a static scenario use manner of a base plus a loudspeaker, a mobile scenario use manner of a loudspeaker plus a mobile phone APP, and a separate Bluetooth loudspeaker use form), to meet scenario requirements of various states. In addition, users who like to collect IP figures/garage kits only need to purchase upper loudspeakers and do not need to repeatedly purchase entire sets (that is, a loudspeaker plus a base), to further reduce the later value-added purchase costs of users. The use of the entire smart loudspeaker product can better cover various use scenarios of users.

Figure 16:
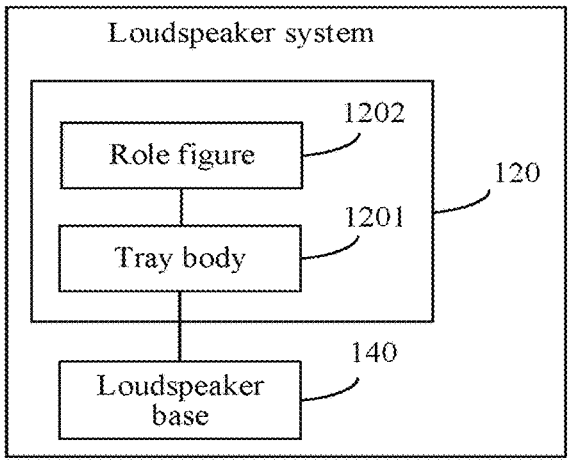
FIG. 16 is a schematic structural diagram of a loudspeaker system according to an exemplary embodiment of the present disclosure.

A loudspeaker system is provided according to another exemplary embodiment of this application. Referring to FIG. 16, the loudspeaker system includes a loudspeaker base 140 and a loudspeaker peripheral 120 that are independent of each other. The loudspeaker peripheral 120 is replaceable, and the loudspeaker base 140 and the loudspeaker peripheral 120 may be in a contact connection or a non-contact connection. The loudspeaker peripheral 120 includes a tray body 1201. The tray body 1201 has a role figure 1202.

The loudspeaker system provided in this exemplary embodiment of the present disclosure includes a loudspeaker base and a loudspeaker peripheral that are independent of each other. The loudspeaker peripheral is replaceable. The loudspeaker peripheral includes a tray body and a role figure on the tray body. Compared with an integrated body structure, in addition to basic functions, the loudspeaker system provided in this embodiment of this application can further change role figures flexibly and have better extensibility, to adapt to more scenarios.

Schematically, the tray body 1201 may have an insertion member. The loudspeaker base 140 is provided with a limit groove. The loudspeaker peripheral 120 is inserted into the limit groove through the insertion member, to implement a connection between the loudspeaker base 140 and the loudspeaker peripheral 120. Certainly, other connection manners may be used. This is not limited in this application.

An example in which the loudspeaker peripheral 120 is a smart loudspeaker is used. The appearance of the smart loudspeaker may be shown in FIG. 2 and FIG. 3. The loudspeaker base 140 and the loudspeaker peripheral 120 are independent of each other, so that the loudspeaker peripheral 120 is replaceable, and the role figure 1202 on the tray body 1201 is changed accordingly. The loudspeaker base and the loudspeaker peripheral may match at any time to meet personalized requirements of users. In addition, the loudspeaker peripheral 120 may further implement a loudspeaker function independently. For the examples and descriptions of the smart loudspeaker, reference is made to the preceding descriptions.

Figure 17:
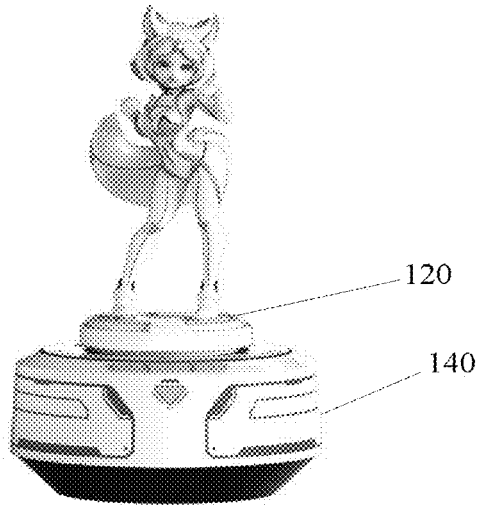
FIG. 17 is a schematic structural diagram of a loudspeaker system according to an exemplary embodiment of the present disclosure.
Figure 18:
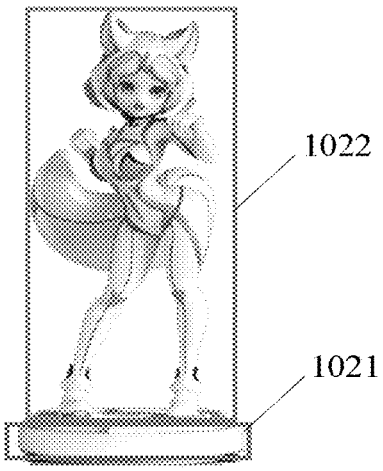
FIG. 18 is a schematic structural diagram of a loudspeaker peripheral according to an exemplary embodiment of the present disclosure.
Figure 19:
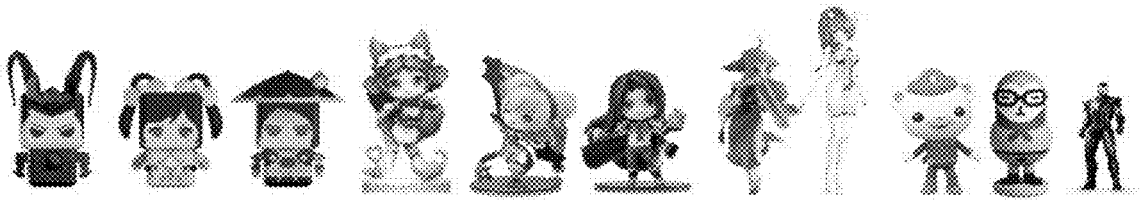
FIG. 19 is a schematic diagram of a role figure according to an exemplary embodiment of the present disclosure.

It is to be understood that, the role figure 1202 in FIG. 17 and FIG. 18 is only an example. The role figure 1202 is not limited in this exemplary embodiment of the present disclosure. In addition to the role figure 1202 shown in FIG. 17 and FIG. 18, there may be role figure 1202 in other product forms. For example, a plurality of role figures shown in FIG. 19 may all be applied to the loudspeaker provided in this embodiment of this application. Certainly, there may be other role figures. Users may customize favorite role figures.

Based on the loudspeaker provided in this exemplary embodiment of the present disclosure, the user can perform effective extension according to a use scenario of the loudspeaker peripheral to meet scenario requirements of various states. In addition, users who like collecting role figures only need to purchase upper role figure products. The loudspeaker base is used as a basic extended device. It is not necessary to repeatedly purchase entire sets, to further reduce the later value-added purchase costs of users. In addition, the loudspeaker provided in this exemplary embodiment of the present disclosure may be compatible with other extended role figures, so that users can choose role figures at will, so that the product value can be effectively improved, thereby improving user experience to some extent.

Figure 20:
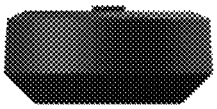
FIG. 20 is a schematic diagram of a loudspeaker base according to an exemplary embodiment of the present disclosure.
Figure 21:
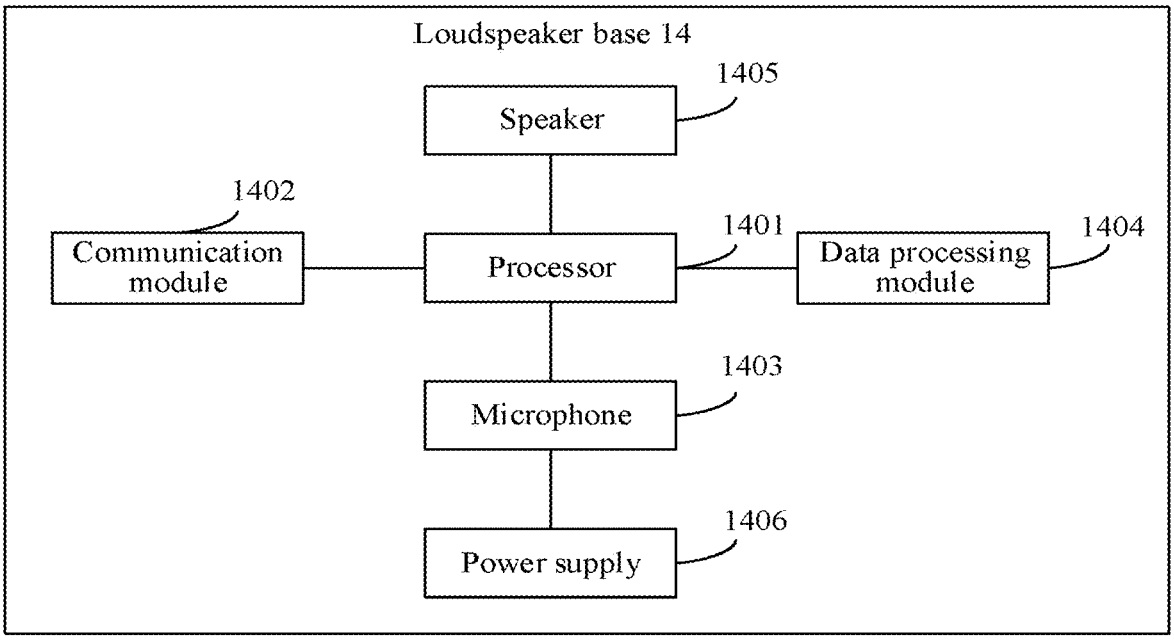
FIG. 21 is a schematic structural diagram of a loudspeaker base according to an exemplary embodiment of the present disclosure.

In a schematic embodiment shown in FIG. 20, the loudspeaker base 140 includes a base housing. The material of the base housing may be plastic, metal or another material. This is not limited in this exemplary embodiment of the present disclosure. In addition, the color of the base housing may be black or may be colored. Other colors may be alternatively chosen. This is also not limited in this exemplary embodiment of the present disclosure. Further, as shown in FIG. 21, the inside of the base housing includes, but is not limited to, a processor 1401 and a communication module 1402 used for network connection, a microphone 1403 configured to acquire voice data, a data processing module 1404 configured to process data, a speaker 1405, and a power supply 1406 that are connected to the processor 1401. These modules and components may be implemented by circuitry, for example. The communication module 1402 may be a wireless communication module or a wired communication module. The wireless communication module may be a Wi-Fi communication module. The wired communication module may be an RJ-45 module. An example in which the communication module 1402 is a Wi-Fi communication module is used in this exemplary embodiment. The power supply 1406 may be a rechargeable battery or may be a linear power supply. There may be one or more microphones 1403 and one or more loudspeakers 1405. This is not limited in this exemplary embodiment of the present disclosure.

Schematically, the loudspeaker base 140 may have basic functions of a loudspeaker. The basic functions include, but are not limited to, one or more functions of a weather forecast and search function, an alarm function, a music playback function, a news broadcast function, and an FM broadcasting function. For example, when implementing a weather forecast and search function, the processor 1401 in the loudspeaker may control the communication module 1402 to connect to the network, for example, to a website that can provide a weather search service. After weather information is obtained, the speaker 1405 is controlled to play the weather information.

In another example, when implementing the alarm function, the processor 1401 in the loudspeaker may establish, through the communication module 1402, a network connection with a mobile phone, a tablet computer or another terminal capable of setting an alarm function, so as to obtain a set alarm time. When the time is reached, the speaker 1405 is controlled to send out a voice prompt to implement the alarm function. Certainly, in addition to a manner of establishing a network connection with another terminal through the communication module 1402 to set an alarm time, the loudspeaker provided in this exemplary embodiment of the present disclosure may further provide a display panel. An alarm setting interface is displayed through the display panel, so as to obtain an alarm time based on the alarm setting interface.

In another example, when implementing the music playback function, the processor 1401 in the loudspeaker may be connected to a network through the communication module 1402, for example, to a website that can provide an audio file. After the audio file is obtained, the speaker 1405 of the loudspeaker is controlled to play the audio file. In addition, in an optional manner, the loudspeaker base 140 is provided with a data interface. A user may transmit an audio file to the loudspeaker through the data interface. For example, a data storage device of the user is connected to the data interface. An audio file in the data storage device is transmitted to the loudspeaker for the speaker 1405 of the loudspeaker to play. The data interface may be a data interface in any form, provided that data can be transmitted. For example, the data interface may be a universal serial bus (USB) interface or may be a Bluetooth component. A Bluetooth connection is performed through the Bluetooth component to transmit data. For any form of data interface, in this way, users may transmit audio files to the loudspeaker according to their personal preferences, so as to meet personalized requirements of the users. It is to be understood that, there are a plurality of types of data interfaces. That is, the loudspeaker base may include one or more data interfaces, so as to support connections between different types of data storage devices and the loudspeaker.

In another example, when implementing a news broadcasting function, the processor 1401 in the loudspeaker may be connected to a network through the communication module 1402, for example, to a website that can provide news content. After a file including the news content is obtained, the file is played through the speaker 1405 of a smart device. In addition, the loudspeaker base 140 further includes a display screen. Therefore, news content to which a user subscribes is set through the display screen, so as to obtain the news content to which the user subscribes after the communication module 1402 of the loudspeaker is connected to the network. The news content is then played through the speaker 1405.

In another example, when implementing an FM broadcasting function, the loudspeaker may be connected to a radio station by the communication module 1402 to obtain FM broadcasting content. The FM broadcasting content is then played through the speaker 1405.

In an optional manner, after the loudspeaker is turned on, buttons may be used to trigger the implementation of the corresponding basic functions above. For example, the loudspeaker base includes a trigger button corresponding to each basic function. A trigger button corresponding to any basic function may be used to implement the corresponding basic function. The trigger button may be a mechanical button, schematically, may be alternatively an option displayed on the display screen. Different options correspond to different basic functions. Alternatively, the microphone 1403 may acquire voice data. The processor 1401 may process the voice data and recognize a voice instruction, so as to control and implement the foregoing basic functions. The implementation form is not limited in this embodiment of this application.

In an exemplary schematic embodiment, the loudspeaker base 140 includes a base housing. The base housing includes an SOC, or System on a Chip. The SOC is a system or product formed by combining a plurality of integrated circuits with specific functions on a chip, and a complete hardware system and embedded software carried by the hardware system are included. That is, the function of an electronic system can be implemented on a single chip. Through the SOC, the loudspeaker may be used in one or more functions in data storage, data signal processing, acoustic capability processing, motor signal processing, wireless signal connection, and the implementation of data processing and interaction in combination with an operating system. The loudspeaker provided in this embodiment of this application may have a complete robot form. In addition to the foregoing basic functions, voice interaction, motion feedback, AI guidance, and the like may further be implemented.

In the voice interaction, an external voice is recognized through the SOC to make a corresponding response. Schematically, the user gives a voice instruction. The loudspeaker performs, after acquiring voice data, a voice recognition on the voice data, to further make give a corresponding response based on a recognition result. For example, the user gives a voice instruction "Play music" to the loudspeaker, then the voice data is recognized through the SOC, and the music is played based on a recognition result. In another example, the user gives a voice instruction of "What is the weather today" to the loudspeaker. The voice data is then recognized through the SOC. Current weather information is obtained based on a recognition result and is then played.

Schematically, in addition to the recognition of a voice instruction given by a user to implement a voice interaction function, because the SOC may further implement a wireless signal connection, the loudspeaker may communicate with another loudspeaker, to implement a voice interaction between different loudspeakers.

In the motion feedback, an application scenario is recognized through the SOC, and the loudspeaker peripheral 120 is controlled based on different application scenarios to move. For example, a current loudspeaker is in a music playback scenario. The loudspeaker peripheral 120 may be controlled, according to music rhythm, to move at different speeds.

In an exemplary schematic embodiment, the loudspeaker base 140 further includes a first rotation mechanism. The first rotation mechanism is configured to drive the loudspeaker peripheral 120 connected to the loudspeaker base 140 to rotate. Schematically, the first rotation mechanism may be disposed in a middle region between the loudspeaker base 140 and the loudspeaker peripheral 120. In the first rotation mechanism, the foregoing motion feedback function may be implemented. Schematically, the first rotation mechanism includes a motor. The motor works under the control of the SOC, so as to control the movement speed of the loudspeaker peripheral 120. In addition, the rotation mechanism may further be configured to implement sound source positioning. For example, when it is detected that a user gives a voice instruction, the location of the user is determined by positioning through the SOC. If the role figure 1202 on the loudspeaker peripheral 120 does not face a direction in which the user gives the voice instruction, the rotation mechanism may drive the loudspeaker peripheral 120 to move, so as to make the role figure 1202 face the direction in which the user gives the voice instruction.

In an exemplary schematic embodiment, the loudspeaker peripheral 120 provided in this exemplary embodiment of the present disclosure has the foregoing functions, in addition, a peripheral 1201 on the loudspeaker peripheral 120 may further have an identity (ID) card (that is, electronic identification information). On such a basis, the loudspeaker base 140 may identify the ID card, so as to determine an identity corresponding to the role figure 1202 on the loudspeaker peripheral 120. On such as basis, a service matching the loudspeaker peripheral 120 can be provided. For example, in a game APP, a role voice actor recording original corpus, TTS speech synthesis, a dedicated emotionalized corpus features, and other functions are provided for the identified identity.

To provide the role voice actor recording original corpus is to provide a voice audio recording corpus corresponding to the identity. For example, the role figure 1202 is a human storytelling figure. The storytelling figure has a personalized timbre. In view of this, original recording data of the object may be obtained. After recognizing the role figure 1202, the loudspeaker may use the original recording data when providing a voice playback function, so as to provide a timbre matching the role figure 1202 to play the voice data.

In the TTS speech synthesis, a text may be synthesized into speech, and voice data of a matching timbre is provided for the role figure 1202. The customized emotionalized corpus features may provide a corpus matching the role figure 1202 after identifying the identity of the role figure 1202. An example in which the role figure 1202 is a game character in a game is used. After recognizing the role figure 1202, a feature corpus of the game character may be obtained, and the feature corpus matching the role figure 1202 is provided when providing a voice service.

In an exemplary schematic embodiment, in addition to a manner of arranging a rotation mechanism on the loudspeaker base 140, a first rotation mechanism may further be disposed on the loudspeaker peripheral 120. The first rotation mechanism drives the loudspeaker peripheral 120 to rotate, so as to implement the foregoing motion feedback and sound source positioning function.

In the AI guidance, the features of a role figure on the loudspeaker are intelligently analyzed through an SOC to provide corresponding guidance information. For example, the role figure is a character in a game. After identifying the identity of the game character through the SOC, during the user's game, a game strategy based on the game character is provided and is played in a voice form. An AI voice feedback function at a user level or an AI strategy analysis function in a battle for a game APP can be implemented. When implementing the AI strategy analysis function in a battle, because the role figure 1202 on the loudspeaker peripheral 120 is the same as the appearance of a game role in a game, the online user experience and offline user experience become consistent by using AI guidance.

In an exemplary schematic embodiment, the loudspeaker peripheral may implement the foregoing basic functions and the voice interaction, the motion feedback, the AI guidance, and other functions, and in addition, a base housing of the loudspeaker peripheral is provided with a display lamp. The loudspeaker may perform light feedback through the display lamp. For example, when the role figure 1202 on the loudspeaker peripheral 120 rotates with the music, the display lamp may emit different colors of light to match a current music scenario to render the atmosphere. In addition, the display lamp may further be simply used for illumination. When detecting a voice instruction "Turn on the light" given by the user, the display lamp is controlled to work by recognizing the voice instruction. Schematically, the display lamp may be a strip and is disposed around the connection between the loudspeaker base 140 and a loudspeaker tray 120. Certainly, in addition to the form of a light strip, the display lamp may further be one or more independent lamps, disposed at corresponding locations of the loudspeaker base 140. A product form, a quantity, and the location of the display lamp are not limited in this exemplary embodiment of the present disclosure.

In an exemplary schematic embodiment, the loudspeaker base 140 is further provided with an adapter. The loudspeaker base 140 is connected to the loudspeaker peripheral 120 by the adapter. Schematically, by the adapter, the loudspeaker base 140 may match loudspeaker peripherals 120 with different role figure 1202, to provide a service matching the loudspeaker peripheral 120.

In an exemplary schematic embodiment, the adapter includes a physical interface. The loudspeaker peripheral is connected to the loudspeaker base by the physical interface. The physical interface includes, but is not limited to, a pogo pin interface, a USB interface, a Type-C (a USB hardware interface specification) interface, and a lightning interface. The form of the physical interface is not limited in this exemplary embodiment of the present disclosure.

In an exemplary schematic embodiment, the adapter includes a wireless connection component. The loudspeaker tray is connected to the loudspeaker base by the wireless connection component. The wireless connection component may be a Wi-Fi connection component, a Bluetooth connection component, an infrared connected component, and the like. The wireless connection component is also not limited in this exemplary embodiment of the present disclosure.

Figure 22:
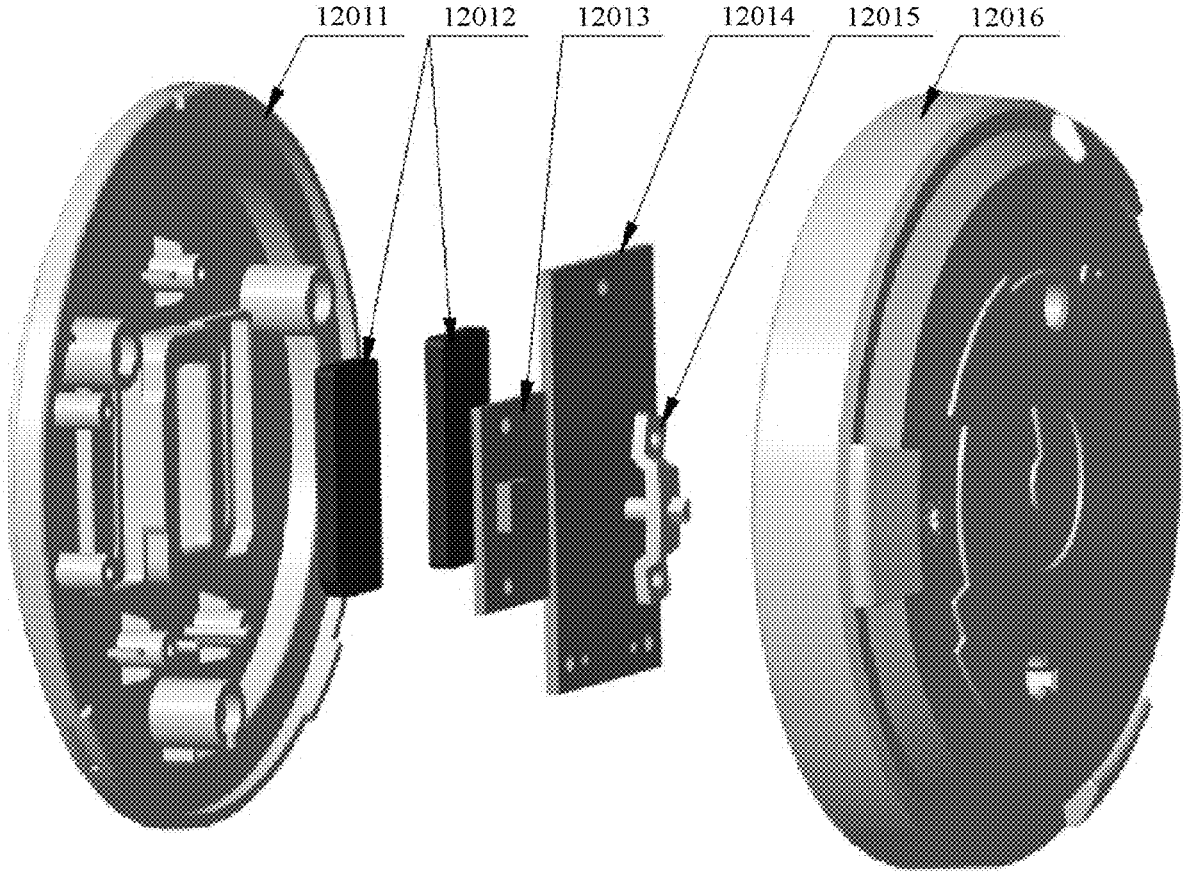
FIG. 22 is a schematic structural diagram of a tray body according to an exemplary embodiment of the present disclosure.

In an exemplary schematic embodiment, the structure of a tray body 1201 on the loudspeaker peripheral 120 may be shown in FIG. 22. FIG. 22 is an exploded view of the tray body 1201. The tray body 1201 successively includes a bottom housing 12011, a magnet 12012, an indicator lamp board 12013, a motherboard 12014, an indicator lamp 12015, and a front housing 12016. The bottom housing 12011 and the front housing 12016 form a housing of the tray body 1201. The magnet 12012, the indicator lamp board 12013, the motherboard 12014, and the indicator lamp 12015 are located inside the housing.

In addition, to enable the indicator lamp 12015 to be displayed, the front housing 12016 has a display exit corresponding to the indicator lamp 12015. Alternatively, a location region, corresponding to the indicator lamp 12015, on the front housing 12016 is made of a nonopaque material, so that light emitted by the indicator lamp 12015 can pass through the front housing 12016. The indicator lamp board 12013 may control the on and off of the indicator lamp 12015 based on the control of the motherboard 12014. In a schematic embodiment, the indicator lamp 12015 may be an indicator lamp having a color. The indicator lamp board 12013 may further be configured to control the color of the indicator lamp 12015. In addition to the control of the indicator lamp board 12013, the motherboard 12014 may further store a role ID of the role figure 1202. For example, the role ID may be disposed on the motherboard 12014 in the form of an ID card. The ID of the role figure 1202 is used for identifying a specific figure of the role figure 1202. For example, the loudspeaker base 140 may identify the ID of the role figure 1202, to provide a service matching the role figure 1202.

Schematically, the loudspeaker peripheral 120 may be magnetically connected to the loudspeaker base 140. The magnet 12012 in the loudspeaker peripheral 120 is configured to match a magnet in the loudspeaker base 140, to implement a magnetic connection between the loudspeaker peripheral 120 and the loudspeaker base 140.

Figure 23:
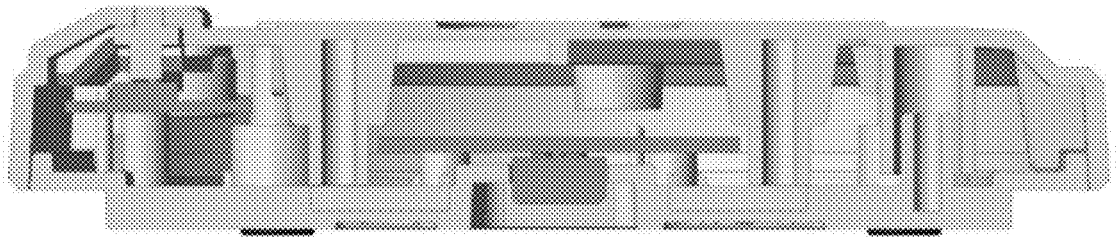
FIG. 23 is a schematic structural diagram of a tray body according to an exemplary embodiment of the present disclosure.
Figure 24:
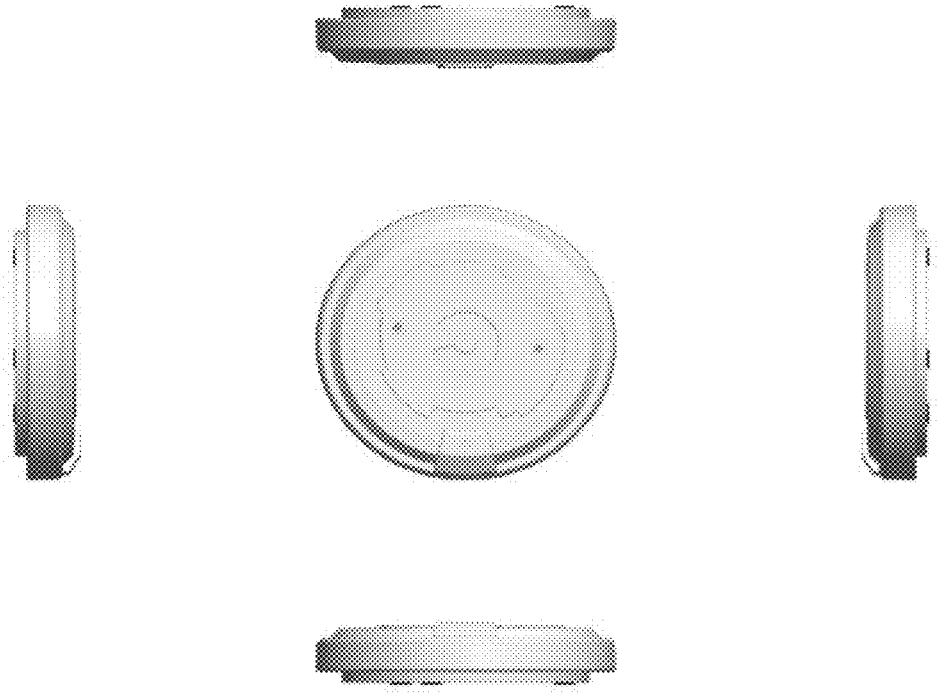
FIG. 24 is a schematic diagram of a tray body at different angles of view according to an exemplary embodiment of the present disclosure.

After the elements of the tray body 1201 shown in FIG. 22 are combined, the structure of the combined tray body 1201 may be shown in FIG. 23. Reference may be made to the appearance shown in FIG. 18 at the same time, and views of the tray body 1201 at different angles of view may be shown in FIG. 24.

Figure 25:
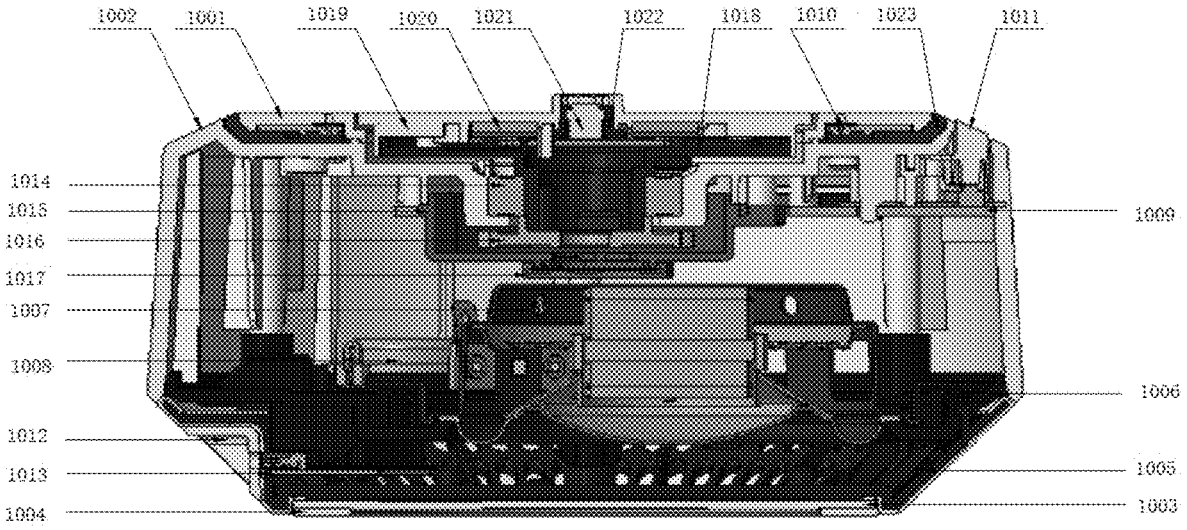
FIG. 25 is a schematic structural diagram of a loudspeaker base according to an exemplary embodiment of the present disclosure.

An example in which the smart peripheral is a smart loudspeaker is used. The structure of the loudspeaker base 140 may be shown in FIG. 25. In FIG. 25, the loudspeaker base 140 includes a front housing 1001, a middle housing 1002, and a bottom housing cover 1003. The front housing 1001, the middle housing 1002, and the bottom housing cover 1003 form a housing of the loudspeaker base 140. The bottom housing cover 1003 further includes an anti-slip mechanism 1004. For example, the anti-slip mechanism 1004 may be an anti-slip silicone pad.

A mesh frame component and mesh cloth 1005 located above the bottom housing cover 1003 are provided inside the housing. The mesh frame component and the mesh cloth 1005 are provided with a speaker support 1006. The speaker support 1006 is provided with at least one of an extra bass speaker 1007 and a tweeter 1008. In addition, a motherboard 1009 and a microphone (MIC) board 1400 are further provided inside the housing. The motherboard 1009 is connected to the MIC board 1400, the extra bass speaker 1007, and the tweeter 1008 respectively, and is configured to control a microphone on the MIC board 1400 to acquire voice data, and control the extra bass speaker 1007 and the tweeter 1008 to play audio. The motherboard 1009 is further connected to a push-button 1401. The outside of the housing is provided with an exit for exposing the push-button 1401. For example, an exit matching the push-button 1401 is provided in the front housing 1001. Alternatively, an exit matching the push-button 1401 is provided in the middle housing 1002. Regardless of the position of the exit, there may be a plurality of push-buttons 1401. The push-buttons 1401 transmit different trigger signals to the motherboard 1009, to trigger the motherboard 1009 to control the microphone on the MIC board 1400 to acquire voice data and to control the extra bass speaker 1007 and the tweeter 1008 to play audio.

To implement data transmission, the loudspeaker base 140 further includes a USB support 1402. The USB support 1402 is provided with a USB board 1403. The USB support 1402 and the USB board 1403 may be disposed on the mesh frame component and the mesh cloth 1005, and are located below the extra bass speaker 1007 and the tweeter 1008. The USB board 1403 has a USB interface. The housing is provided with an exit matching the USB interface, so that a USB device may be inserted from the outside of the housing through the USB interface.

Schematically, the loudspeaker base 140 may further be provided with a rotation mechanism. The rotation mechanism drives the loudspeaker peripheral 120 to rotate, so as to implement the foregoing motion feedback and sound source positioning function. As shown in FIG. 10, the rotation mechanism includes a bearing 1404, a motor cover support 1405, a gear 1406, and a sealing cover 1407. The motor cover support 1405 is provided with a motor (not shown in the figure). The bearing 1404 has a rotary table support 1408. The rotary table support 1408 is provided with a rotary table cover 1409 and a rotary table (not shown in the figure). Rotation power is provided for the gear 1406 through the motor, so that the gear 1406 rotates to drive the rotary table on the rotary table support 1408 to rotate, so as to drive the loudspeaker peripheral 120 to rotate.

A magnetic connection manner is used for the loudspeaker base 140 and the loudspeaker peripheral 120. The loudspeaker base 140 further includes a magnet 1200. The magnet 1200 may be located on the rotary table cover 1409 and under the front housing 1001. The magnet 1200 on the loudspeaker base 140 matches a magnet 12012 in the loudspeaker peripheral 120 shown in FIG. 22, to implement the magnetic connection between the loudspeaker peripheral 120 and the loudspeaker base 140.

The loudspeaker base 140 is further provided with an adapter. A manner in which the loudspeaker base 140 is connected to the loudspeaker peripheral 120 by the adapter is shown in FIG. 25. An example in which the adapter includes a physical interface and the physical interface includes a pogo pin 1201 is used. Dust silica gel 1202 is further provided around the pogo pin 1201.

To add a light effect, as shown in FIG. 25, the loudspeaker base 140 further has a light-guide ring 1203. The light-guide ring 1203 may be disposed between the front housing 1001 and the middle housing 1002.

Figure 26:
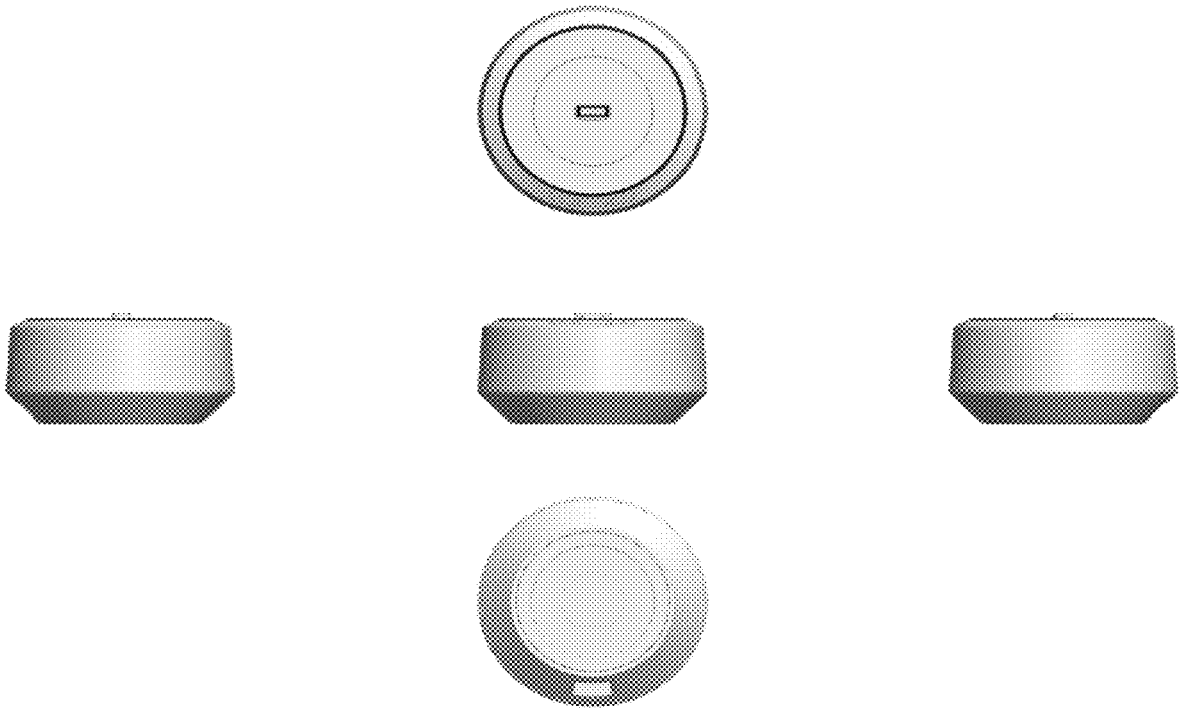
FIG. 26 is a schematic diagram of a loudspeaker base at different angles of view according to an exemplary embodiment of the present disclosure.

Views of the loudspeaker base 140 shown in FIG. 25 at different angles of view may be shown in FIG. 26. In an exemplary schematic embodiment, the loudspeaker peripheral 120 is disposed on the loudspeaker base 140. Alternatively, the loudspeaker peripheral 120 is disposed next to the loudspeaker base 140. Alternatively, the loudspeaker peripheral 120 is disposed under the loudspeaker base 140. Alternatively, the loudspeaker peripheral 120 is remotely connected to the loudspeaker base 140.

In an exemplary schematic embodiment, the loudspeaker peripheral 120 is disposed on the loudspeaker base 140. The bottom of the tray body 1201 is provided with an insertion member, the top of the loudspeaker base 140 is provided with a limit groove, and the loudspeaker peripheral 120 is inserted into the limit groove through the insertion member.

In an exemplary schematic embodiment, the loudspeaker peripheral 120 is disposed under the loudspeaker base 140. The top of the tray body 1201 is provided with an insertion member, the bottom of the loudspeaker base 140 is provided with a limit groove. The loudspeaker peripheral 120 is inserted into the limit groove through the insertion member.

In an exemplary schematic embodiment, the loudspeaker peripheral 120 and the loudspeaker base 140 are magnetic. The loudspeaker peripheral 120 and the loudspeaker base 140 are connected in a suspended manner and transmit data in a non-contact manner. For example, the non-contact manner includes a Bluetooth manner, an infrared manner, and other manners.

Figure 27:
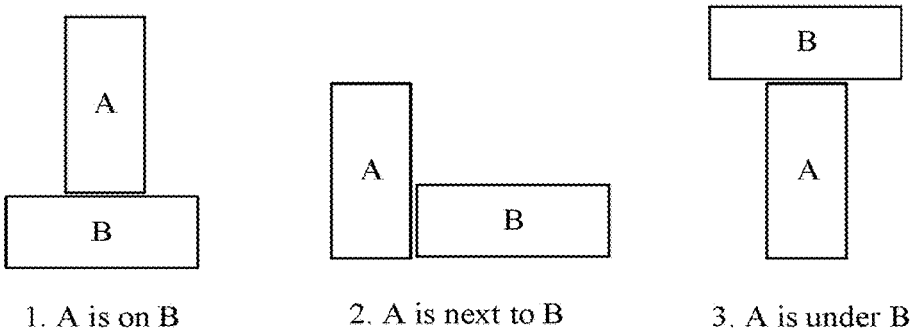
FIG. 27 is a schematic diagram of a connection location of a loudspeaker base and a loudspeaker peripheral according to an exemplary embodiment of the present disclosure.

As shown in FIG. 27, an example in which one of A and B is the loudspeaker peripheral 120 and the other is the loudspeaker base 140 is used. FIG. 27 includes three types of location relationships: 1. A is on B. 2. A is next to B. FIG. 27 only shows a case that A is on the left side of B. A may be alternatively located on the right side, the front or the rear of B. 3. A is under B. A connection manner of the loudspeaker peripheral 120 and the loudspeaker base 140 may be selected by the user, so as to meet the users' personalized requirements.

In addition to the foregoing types of location relationships, the loudspeaker peripheral 120 may be alternatively electrically connected to the loudspeaker base 140 by a wireless component. For example, the wireless component may be a Bluetooth module. The loudspeaker peripheral 120 and the loudspeaker base 140 are in a Bluetooth connection, so that the loudspeaker peripheral 120 is disposed next to the loudspeaker base 140. In another example, the wireless component may be an infrared module. The loudspeaker peripheral 120 and the loudspeaker base 140 are in an infrared connection. Certainly, the loudspeaker peripheral 120 may be alternatively connected to the loudspeaker base 140 by a Wi-Fi module. A manner of an electrical connection between the loudspeaker peripheral 120 and the loudspeaker base 140 is not limited in this embodiment of this application.

Figure 28:
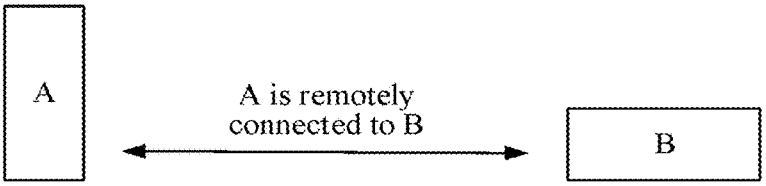
FIG. 28 is a schematic diagram of a connection location of a loudspeaker base and a loudspeaker peripheral according to an exemplary embodiment of the present disclosure.

As shown in FIG. 28, an example in which one of A and B is the loudspeaker peripheral 120 and the other is the loudspeaker base 140 is still used. A and B are not in contact, so that A may be remotely connected to B.

In an exemplary schematic embodiment, the loudspeaker peripheral includes, but is not limited to, a smart loudspeaker, an extended loudspeaker, a pico projector, a transition base, or a smart camera. The pico projector may be a device providing a projection service. The transition base may be a wireless hotspot transition base or may be a charged transition base.

Regardless of the type of the loudspeaker peripheral, the function of the loudspeaker peripheral may be implemented on the loudspeaker base 140. The function of the loudspeaker peripheral may be alternatively implemented on the loudspeaker peripheral 120. The function of the loudspeaker peripheral may be alternatively implemented on the loudspeaker base 140 and the loudspeaker peripheral 120 respectively. The function of the loudspeaker peripheral is determined based on the type of the loudspeaker peripheral. For example, the function of a smart loudspeaker is a loudspeaker function. The function of a smart speaker is a speaker function. The function of a smart camera is a camera function. This is not limited in this exemplary embodiment of the present disclosure.

For example, when the loudspeaker peripheral is the smart loudspeaker, the loudspeaker function may be implemented on the loudspeaker base 140. The loudspeaker function may be alternatively implemented on the loudspeaker peripheral 120. The loudspeaker function may be alternatively implemented on the loudspeaker base 140 and the loudspeaker peripheral 120 respectively.

In another example, when the loudspeaker peripheral is an extended loudspeaker, the speaker function may be implemented on the loudspeaker base 140. The speaker function may be alternatively implemented on the loudspeaker peripheral 120. The speaker function may be alternatively implemented on the loudspeaker base 140 and the loudspeaker peripheral 120 respectively.

In another example, when the loudspeaker peripheral is the smart camera, the camera function may be implemented on the loudspeaker base 140. The camera function may be alternatively implemented on the loudspeaker peripheral 120. The camera function may be alternatively implemented on the loudspeaker base 140 and the loudspeaker peripheral 120 respectively.

In another example, the loudspeaker peripheral is provided with a microphone. The loudspeaker base 140 and the loudspeaker peripheral 120 may be provided with microphones respectively.

In addition, when implementing the function of the loudspeaker peripheral on the loudspeaker base 140 and the loudspeaker peripheral 120 respectively, if the loudspeaker base 140 and the loudspeaker peripheral 120 are in a non-contact connection, the loudspeaker base 140 and the loudspeaker peripheral 120 may perform the function of the loudspeaker peripheral respectively. If the loudspeaker base 140 and the loudspeaker peripheral 120 are in a contact connection, one of the loudspeaker base 140 and the loudspeaker peripheral 120 may perform the function of the loudspeaker peripheral, and switching may be performed between the loudspeaker base 140 and the loudspeaker peripheral 120. Alternatively, which of the loudspeaker base 140 and the loudspeaker peripheral 120 performs the function of the loudspeaker peripheral is determined based on an application scenario.

That is, the technical solutions provided in this exemplary embodiment of the present disclosure may be applied to a plurality of product forms. Some product forms may be loudspeaker peripherals 120 having role figure 1202, and product forms some may be loudspeaker bases 140. For different product forms, the loudspeaker base 140 may be adjusted accordingly, and the loudspeaker peripherals 120 having the role figure 1202 may match the loudspeaker bases 140 in different product forms. In this way, the flexibility is improved, and the utilization of the loudspeaker peripheral 120 having the role figure 1202 is improved.

Next, an example in which the loudspeaker system provided in this exemplary embodiment of the present disclosure is a smart loudspeaker is used for description. A system architecture and an entire process to which this exemplary embodiment of the present disclosure is applied are first described below with reference to FIG. 29 to FIG. 31.

Figure 29:
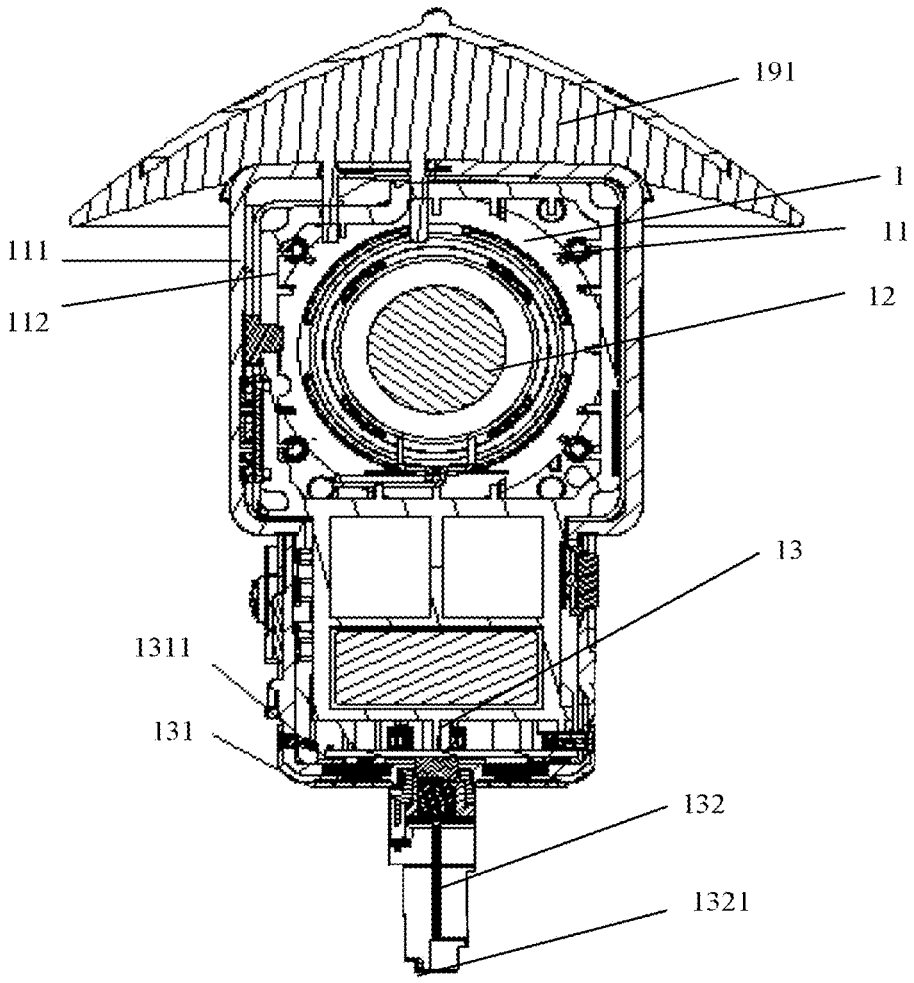
FIG. 29 is a structural diagram of a loudspeaker peripheral according to an exemplary embodiment of the present disclosure.

As shown in FIG. 29, according to an exemplary embodiment of the present disclosure, the loudspeaker peripheral 120 has a cubic loudspeaker body 11 and speakers 12 at openings in two opposite side faces of the loudspeaker body 11. The loudspeaker peripheral 120 may be a conventional loudspeaker or may be a Bluetooth loudspeaker.

A loudspeaker may have any shape, and any face of the loudspeaker may be provided with a speaker for playing sound. The sound effect of such a loudspeaker cannot be optimal. Experiments shows that the sound quality of a cubic loudspeaker body is much higher than that of a loudspeaker body of another shape. When speakers are disposed in two opposite side faces of the loudspeaker body, the sound quality of sound playing is much higher than that in a case that a speaker is disposed in the top face or another side face. Therefore, according to exemplary embodiments of the present disclosure, the shape of the loudspeaker is cubic, and speakers 12 at openings provided in two opposite side faces of the loudspeaker body 11 are provided. In this way, a better effect of playing sound may be achieved.

Figure 30:
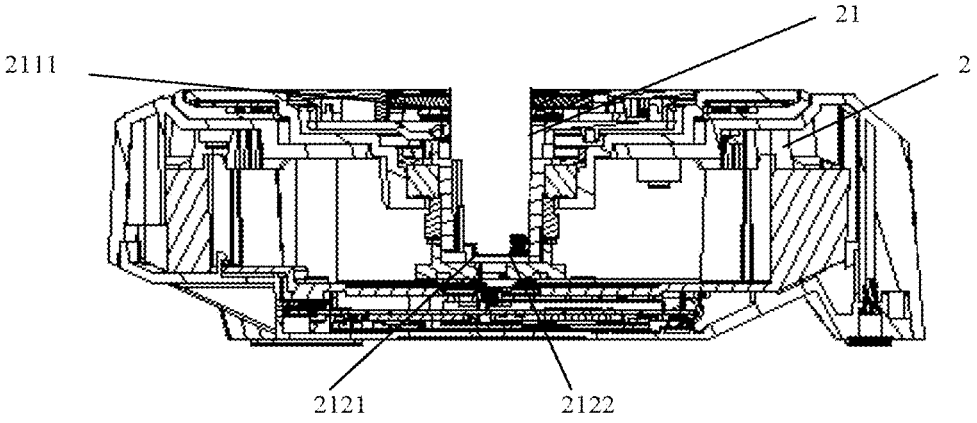
FIG. 30 is a structural diagram of a loudspeaker base according to an exemplary embodiment of the present disclosure.
Figure 31:
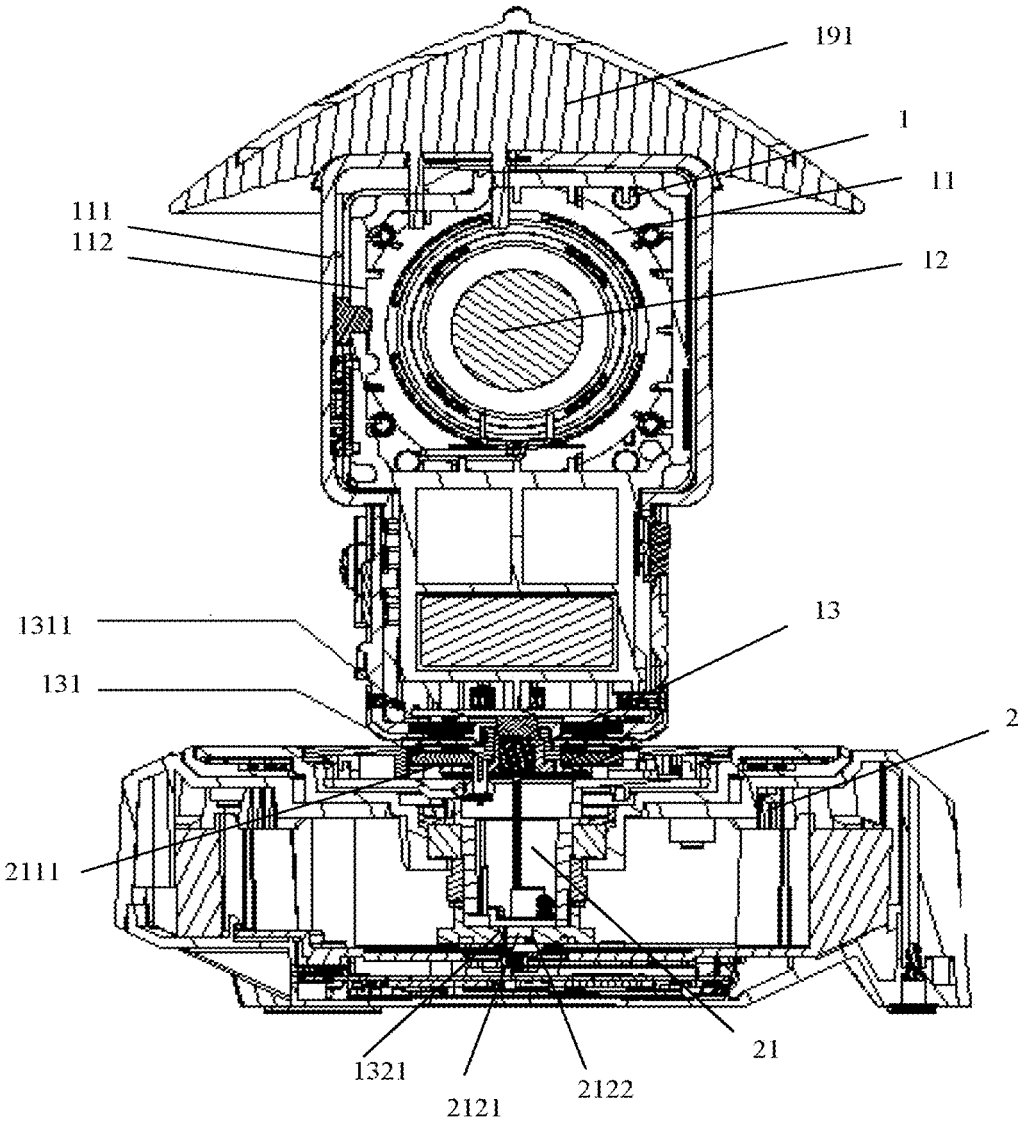
FIG. 31 is a structural diagram showing that a loudspeaker peripheral is inserted into a loudspeaker base according to an exemplary embodiment of the present disclosure.
Figure 32:
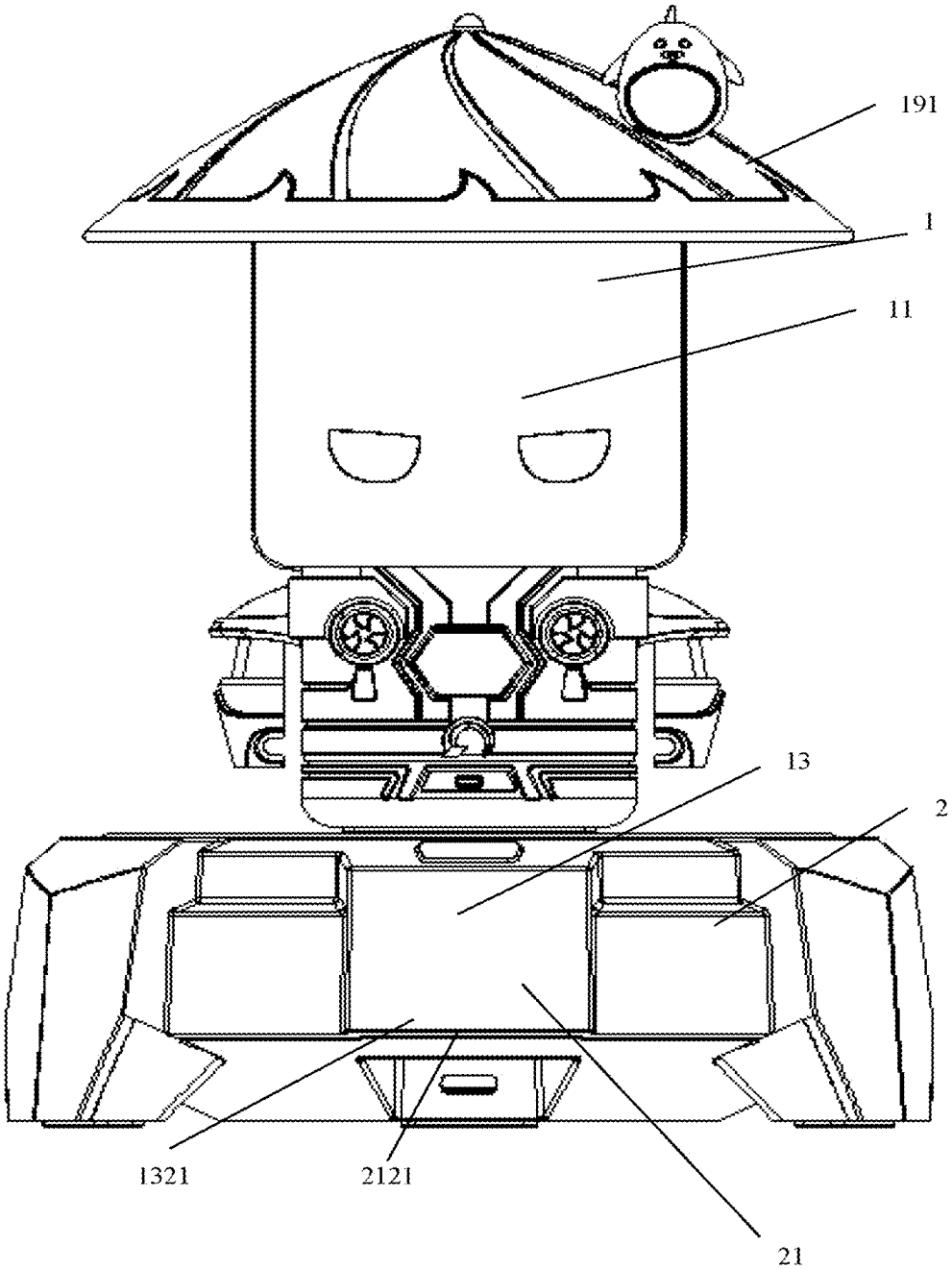
FIG. 32 is a schematic front view showing that a loudspeaker peripheral is inserted into a loudspeaker base according to an exemplary embodiment of the present disclosure.

According to an exemplary embodiment of the present disclosure, as shown in FIG. 30, a loudspeaker base 140 used in cooperation with the loudspeaker peripheral 120 is further provided. The loudspeaker peripheral 120 is a smart peripheral tray component 102. The loudspeaker base 140 is a smart peripheral base 101. The two are independent of each other. As shown in FIG. 29, the loudspeaker peripheral 120 is provided with an inserting part 13 formed by extending downward from the loudspeaker body 11. As shown in FIG. 30, the upper surface of the loudspeaker base 140 is provided with a limit groove 21 that is concave downward. As shown in FIG. 31, the inserting part 13 is inserted into the limit groove 21, to form an integrated structure of the loudspeaker peripheral 120 and the loudspeaker base 140. In this way, the loudspeaker peripheral 120 can work separately, and includes a power supply (which is described in detail below). For example, the loudspeaker peripheral 120 may be used as a Bluetooth loudspeaker to receive a control command and a to-be-played voice of a main control device (for example, a mobile phone used as a control). The to-be-played voice is played through the Bluetooth loudspeaker. Alternatively, the loudspeaker peripheral 120 may be inserted into the loudspeaker base 140, to receive a control command and a to-be-played voice in the loudspeaker base 140 for playing (which is described in detail below). When being inserted into the loudspeaker base 140, the loudspeaker peripheral 120 is not a loudspeaker that can work independently. The loudspeaker peripheral 120 receives electric energy from a power supply in the loudspeaker base 140 for playing. Therefore, the loudspeaker may have two working modes, namely, working independently and receiving the power in the loudspeaker base 140 to play a to-be-played voice indicated in the loudspeaker base 140. A two-mode working manner is formed, thereby improving the operation efficiency of the loudspeaker.

In addition, compared with a manner that a loudspeaker is connected to a base by glue or by a fastener, the appearance of the device is insusceptible to damage during detachment in a manner of an inserting part and a limit groove, thereby achieving the flexibility of use.

In an exemplary embodiment, as shown in FIG. 29, the inserting part 13 includes an inserting platform 131 and an inserting joint 132 that extends downward from the inserting platform 131. The cross section of the inserting platform 131 is smaller than the cross section of the loudspeaker body 11, and the cross section of the inserting joint 132 is smaller than the cross section of the inserting platform 131. Such a manner of a gradually reducing cross sections facilitates the insertion between the loudspeaker peripheral 120 and the loudspeaker base 140. The shape of the inserting platform 131 may be a square cylinder, a prismatic cylinder, a circular cylinder, an elliptic cylinder or the like. The shape of the inserting joint 132 may be a square cylinder, a prismatic cylinder, a circular cylinder, an elliptic cylinder, a cone gradually tapering from the top to bottom, a pyramid or the like.

Accordingly, as shown in FIG. 30, the shape of the limit groove 21 may be a square cylinder, a prismatic cylinder, a circular cylinder, an elliptic cylinder, a cone gradually tapering from the top to bottom a pyramid, or the like. The shape of the limit groove 21 matches the shape of the inserting joint 132, that is, is consistent with the shape of the inserting joint 132. In this way, as shown in FIG. 31, when the loudspeaker peripheral 120 is mounted on the loudspeaker base 140, the loudspeaker peripheral 120 can be firmly combined with the loudspeaker base 140, does not fall off easily, and can be easily detached.

As shown in FIG. 29, a loudspeaker magnet part 1311 is mounted at the bottom of the inserting platform 131, and a loudspeaker pin interface 1321 is mounted at the bottom of the inserting joint 132. The magnet part may be a magnet, a lodestone or any other part that is magnetically attached by using the principle of magnetism. The loudspeaker magnet part 1311 may be mounted at an edge of the bottom of the inserting platform 131 or may be mounted at another location of the bottom. As shown in FIG. 29, the loudspeaker pin interface 1321 includes an electric lead in the loudspeaker peripheral 120 for the loudspeaker peripheral 120 to be connected to the loudspeaker base 140. The electric lead may be mounted right in the middle of the bottom of the inserting joint 132 or may be mounted at another location of the bottom.

As shown in FIG. 30, a base magnet part 2111 is mounted around the limit groove 21 on the upper surface of the loudspeaker base 140. The base magnet part 2111 may be a magnet, a lodestone or any other part that is magnetically attached by using the principle of magnetism. A base pin interface 2121 may be mounted at the bottom of the limit groove 21. In an exemplary embodiment, the base pin interface 2121 may be mounted at the very center of the bottom. Alternatively, the base pin interface 2121 may be mounted at another location of the bottom.

As shown in FIG. 31, when the loudspeaker peripheral 120 is mounted on the loudspeaker base 140, the location of the base magnet part 2111 corresponds to the location of the loudspeaker magnet part 1311. The base magnet part 2111 and the loudspeaker magnet part 1311 are magnetically attracted to each other, so that a connection is more stable. In addition, the location of the base pin interface 2121 corresponds to the location of the loudspeaker pin interface 1321 to implement joint of the interfaces, so that a connection between the loudspeaker peripheral 120 and the loudspeaker base 140 is more stable. Therefore, through the magnetic joint and the interface joint according to this application, the stability of the connection between the loudspeaker peripheral 120 and the loudspeaker base 140 is ensured twice. It may be clearly learned from a front view of a loudspeaker device after the loudspeaker peripheral 120 is mounted on the loudspeaker base 140 shown in FIG. 17.

Figure 34:
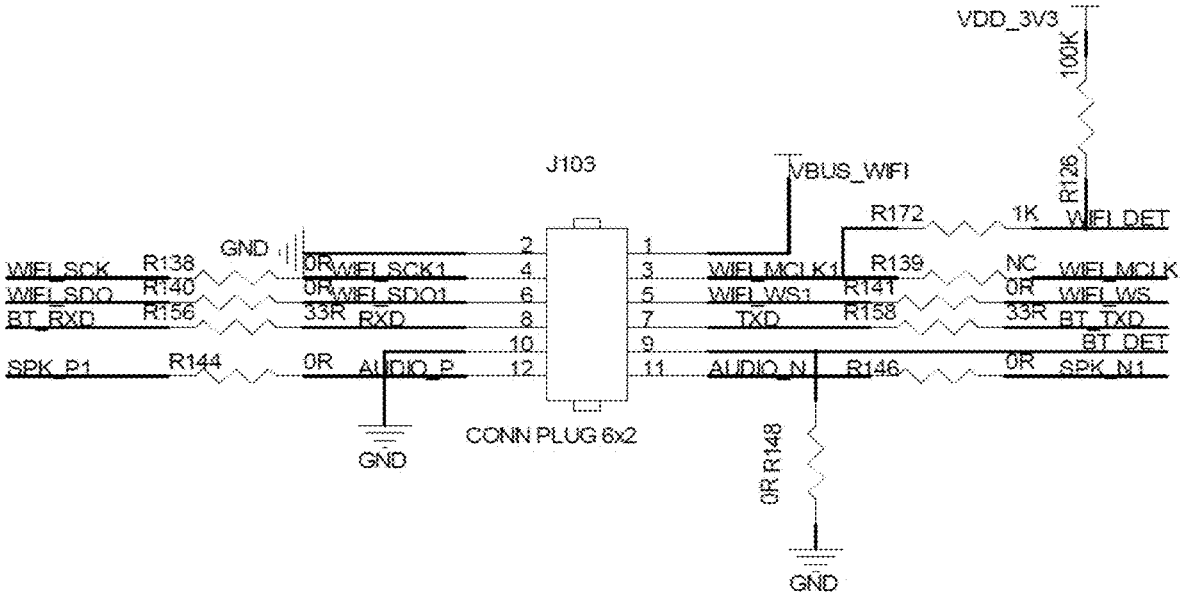
FIG. 34 is a pin diagram of a loudspeaker pin interface according to an exemplary embodiment of the present disclosure.
Figure 42:
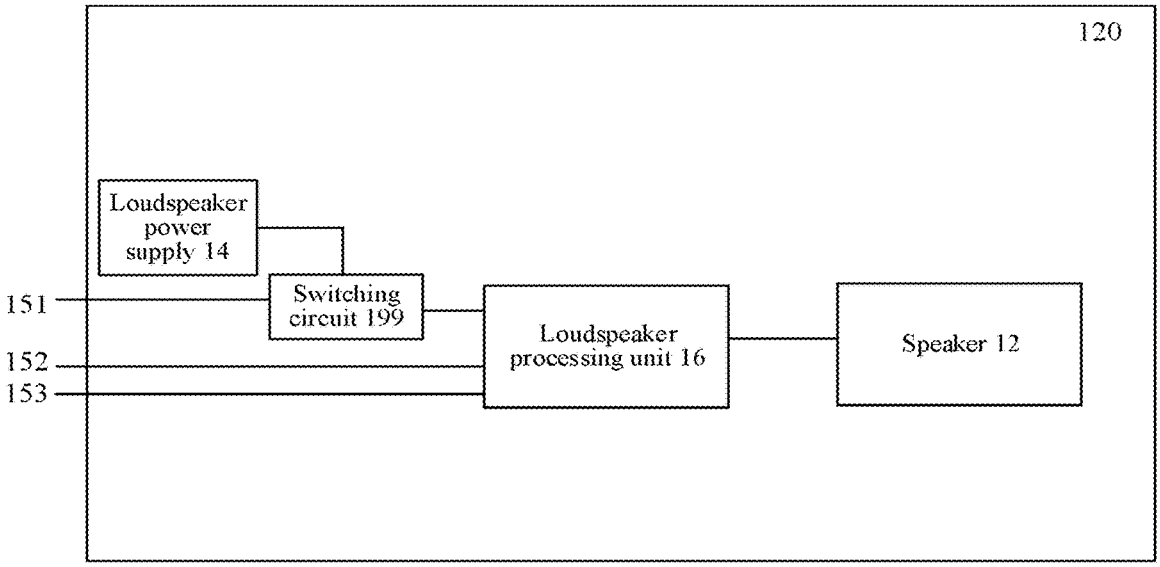
FIG. 42 is a partial block diagram of the internal circuit of a loudspeaker peripheral according to an exemplary embodiment of the present disclosure.

FIG. 34 is a pin diagram of a loudspeaker pin interface 1321. As shown in FIG. 42, these pins include a first audio signal interface 152, a first control signal interface 153, and a first power signal interface 151.

The first audio signal interface 152 is an interface for providing an audio signal for the speaker 12 to play. When the loudspeaker is used independently, the loudspeaker receives an audio signal that is transmitted by a control device (for example, a mobile phone) and needs to be played. When the loudspeaker is not used independently, the loudspeaker receives an audio signal that is from the base and needs to be played. In an embodiment, the first audio signal interface 152 is an I2S interface.

The first control signal interface 153 is an interface for receiving a control signal by the loudspeaker peripheral 120. When the loudspeaker is used independently, the loudspeaker receives a control command from a control device (for example, a mobile phone). When the loudspeaker is not used independently, the loudspeaker receives a control command from the loudspeaker base 140. In an exemplary embodiment, the first control signal interface 153 is a serial interface.

The first power signal interface 151 is an interface for supplying power to the speaker 12. When the loudspeaker is used independently, the loudspeaker is powered by a loudspeaker power supply 14. When the loudspeaker is not used independently, the loudspeaker base 140 supplies power through the first power signal interface 151 for the loudspeaker to work.

Figure 36:
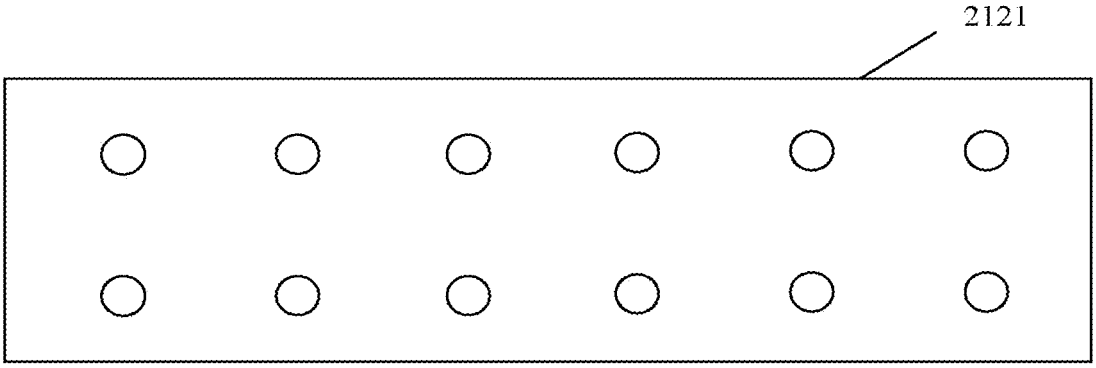
FIG. 36 is a schematic diagram of a base pin interface according to an exemplary embodiment of the present disclosure.
Figure 37:
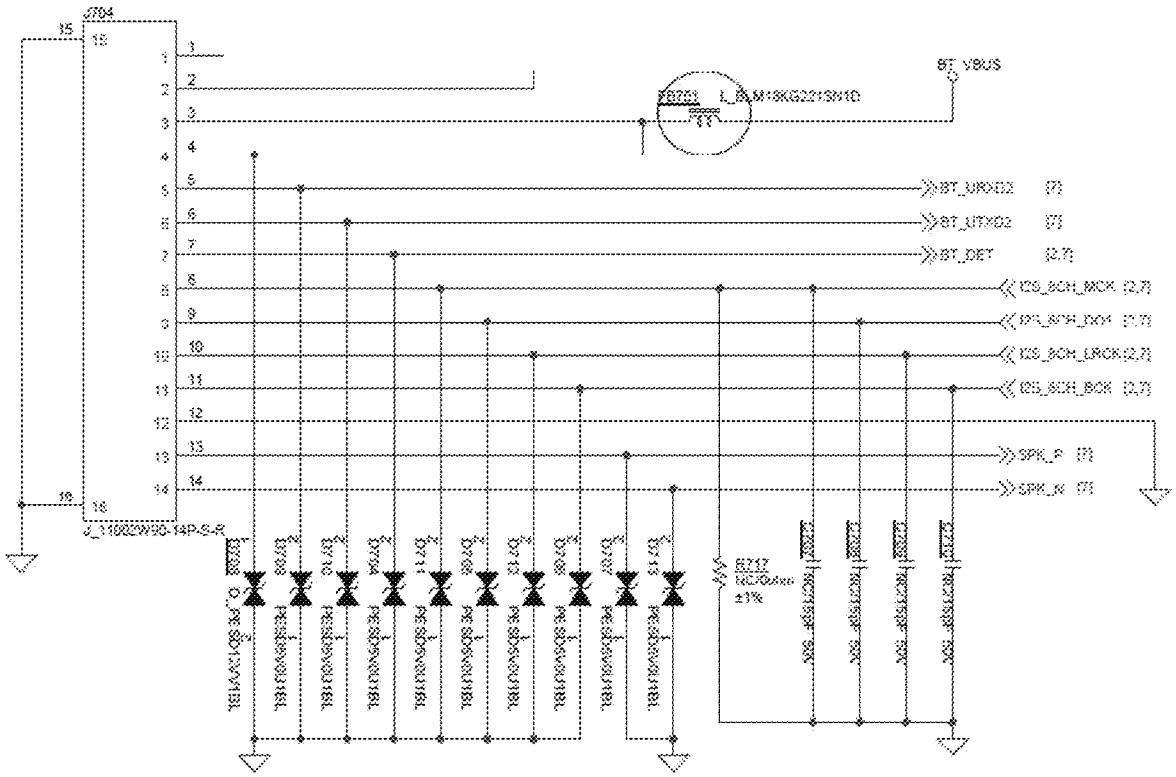
FIG. 37 is a pin diagram of a base pin interface according to an exemplary embodiment of the present disclosure.

FIG. 36 is a schematic diagram of a base pin interface 2121 according to an exemplary embodiment of the present disclosure. FIG. 37 is a pin diagram of a base pin interface 2121 according to an exemplary embodiment of the present disclosure.

Figure 33:
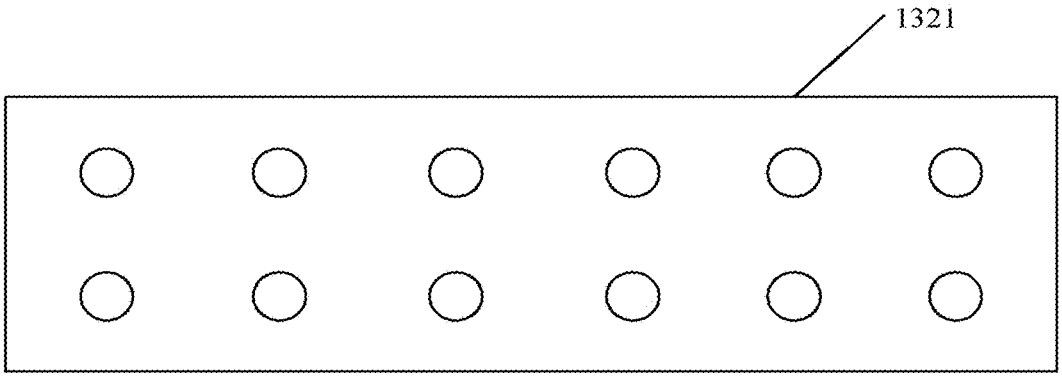
FIG. 33 is a schematic diagram of a loudspeaker pin interface according to an exemplary embodiment of the present disclosure.
Figure 41:
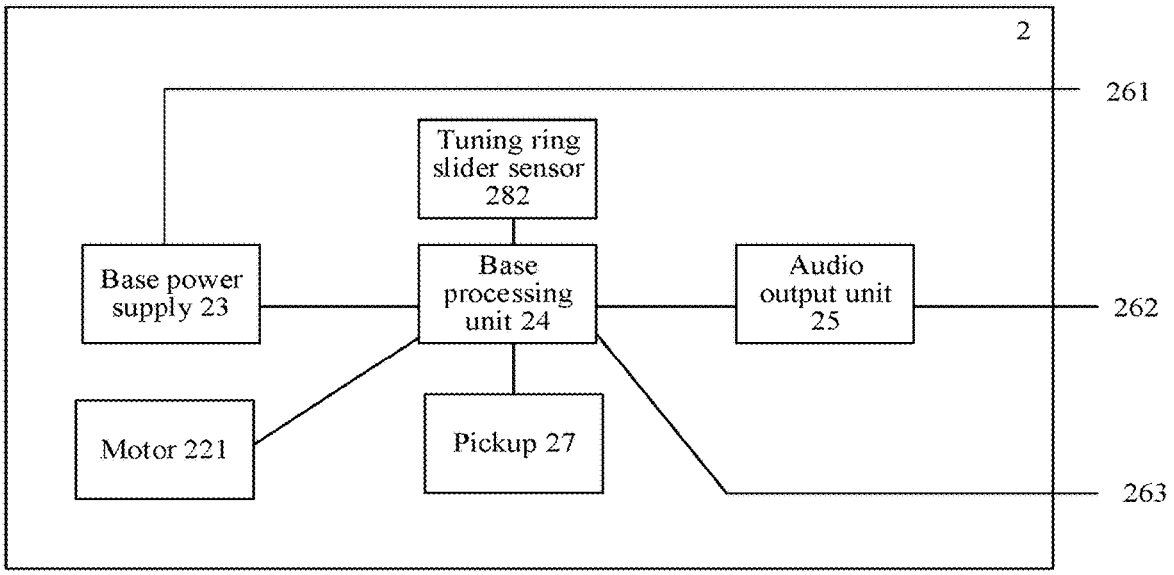
FIG. 41 is a partial block diagram of the internal circuit of a loudspeaker base according to an exemplary embodiment of the present disclosure.

As shown in FIG. 41, the base pin interface 2121 includes a second audio signal interface 262, a second control signal interface 263, and a second power signal interface 261. The location of each pin in the base pin interface 2121 matches the location of each pin in the loudspeaker pin interface 1321 shown in FIG. 33. When the loudspeaker peripheral 120 is mounted on the loudspeaker base 140, the base pin interface 2121 matches the loudspeaker pin interface 1321. In an exemplary embodiment, each pin (including the second audio signal interface 262, the second control signal interface 263, and the second power signal interface 261) in the base pin interface 2121 is a deformable probe, which can deform after being squeezed by an external force, so as to implement better contact. Each pin (including the first audio signal interface 152, the first control signal interface 153, and the first power signal interface 151) in the loudspeaker pin interface 1321 is a non-deformable probe, which does not deform when being in contact with another object. In this way, when the loudspeaker peripheral 120 is mounted on the loudspeaker base 140, a pin in the loudspeaker pin interface 1321 abuts against to a corresponding pin in the base pin interface 2121. The pin in the base pin interface 2121 deforms and the pin in the loudspeaker pin interface 1321 does not deform, thereby achieving a stable contact between the pin in the base pin interface 2121 and the pin in the loudspeaker pin interface 1321.

Figure 47:
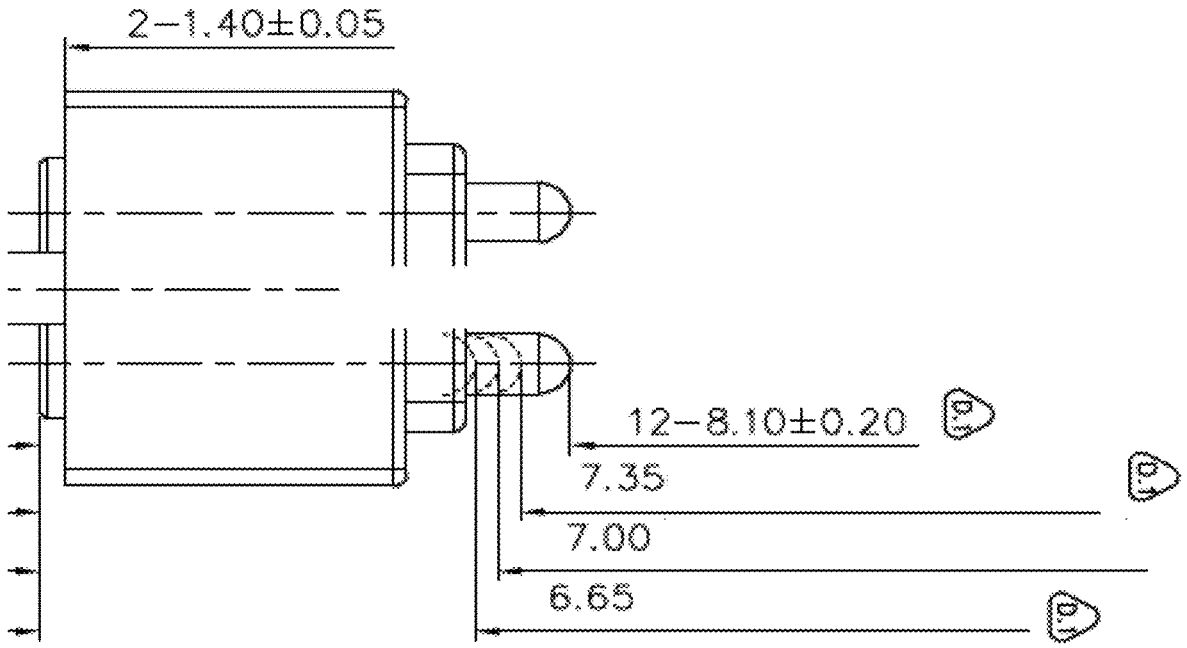
FIG. 47 is a schematic diagram showing that a pin on a base pin interface is a deformable probe according to an exemplary embodiment of the present disclosure.

FIG. 47 is a schematic diagram that a pin on the base pin interface 2121 is a deformable probe according to an exemplary embodiment of the present disclosure. Without abutting against any object, the maximum length of the pin on the base pin interface 2121 during work may be 7.35 mm, a normal length during work may be 7.00 mm, and a length under maximum compression is 6.65 mm, and the deformation is the largest at this time. By using the deformation of the pin on the base pin interface 2121, stable docking is implemented when the loudspeaker peripheral 120 is mounted on the loudspeaker base 140.

As shown in FIG. 31, in an exemplary embodiment, in addition to the base pin interface 2121, a connection detector 2122 is further mounted at the bottom of the limit groove 21. The connection detector 2122 is a device that detects that the loudspeaker peripheral 120 is mounted on the loudspeaker base 140, in other words, is a device that detects that a pin in the loudspeaker pin interface 1321 is in contact with a pin in the base pin interface 2121. When a pin in the loudspeaker pin interface 1321 is in contact with a pin in the base pin interface 2121, it does not represent that a pin in the loudspeaker pin interface 1321 is docked to a corresponding pin in the base pin interface 2121. The connection detector 2122 is used to enable a pin in the loudspeaker pin interface 1321 to be docked to a corresponding pin in the base pin interface 2121 after detecting that the pin in the loudspeaker pin interface 1321 is in contact with the pin in the base pin interface 2121. The first audio signal interface 152 is connected to the second audio signal interface 262. The first control signal interface 153 is connected to the second control signal interface 263. The first power signal interface 151 is connected to the second power signal interface 261. Therefore, the transmission of various signals between the loudspeaker peripheral 120 and the loudspeaker base 140 is implemented when the loudspeaker peripheral 120 works in cooperation with the loudspeaker base 140.

Figure 35:
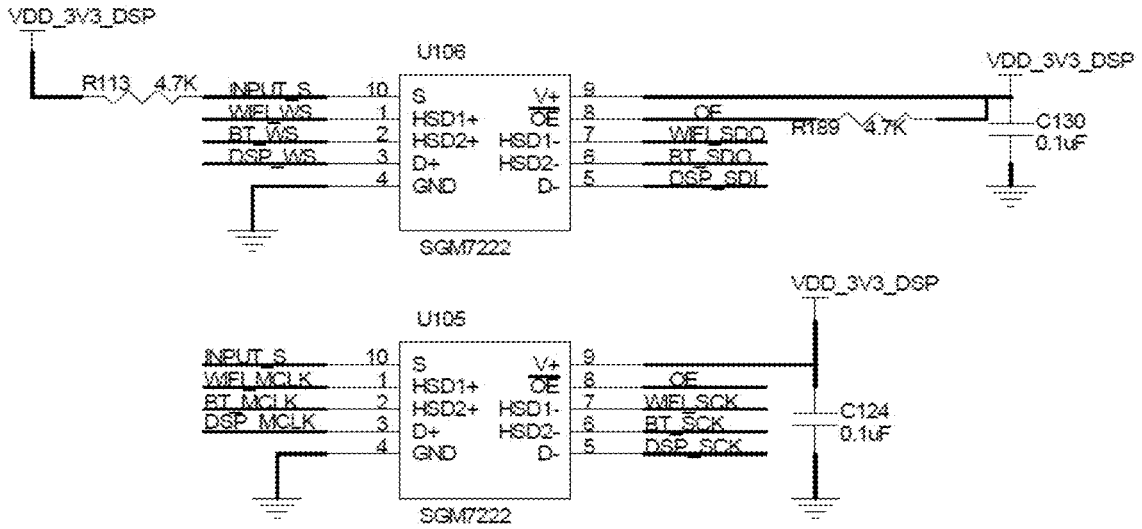
FIG. 35 is a pin diagram of a connector according to an exemplary embodiment of the present disclosure.
Figure 38:
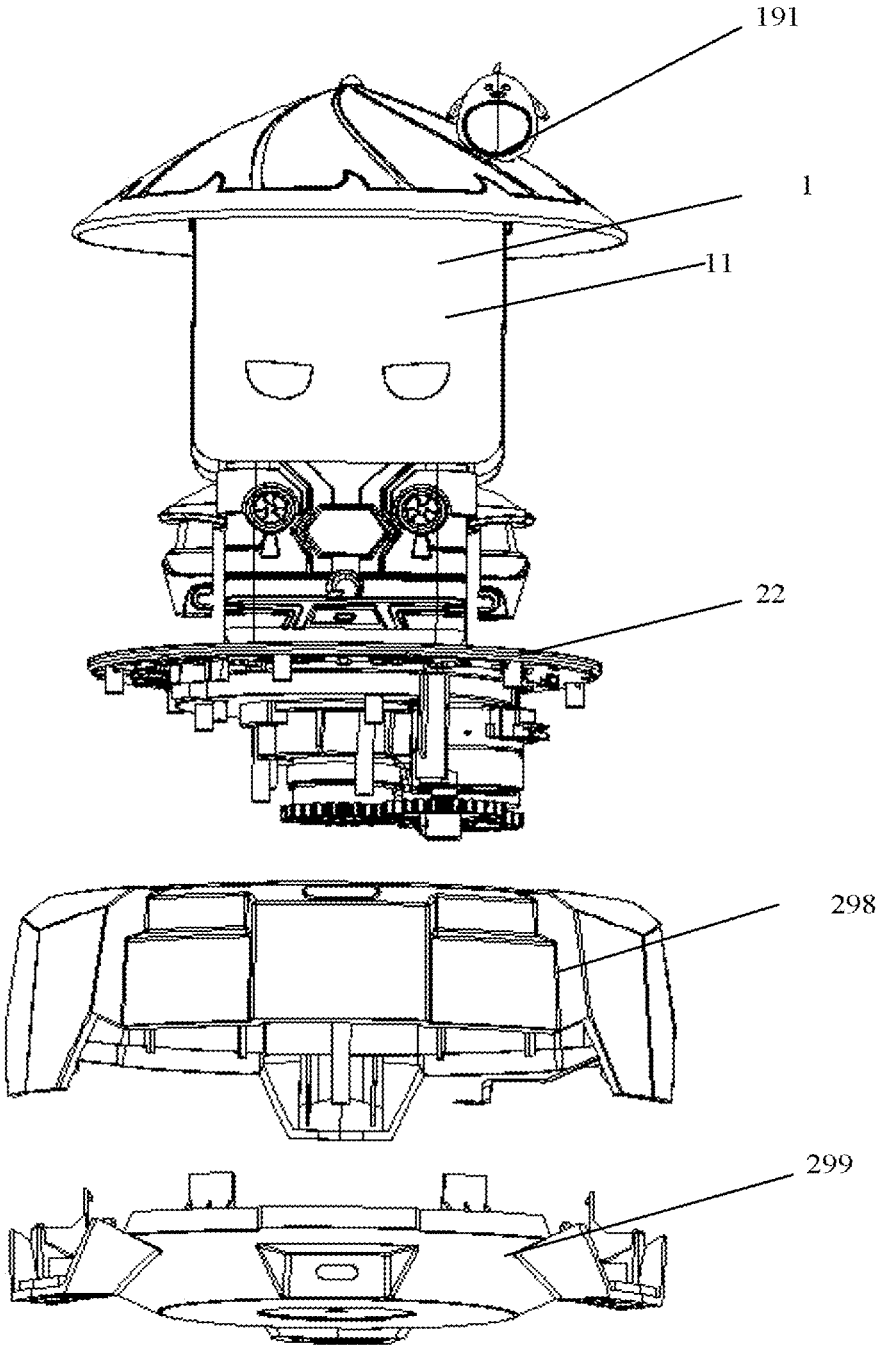
FIG. 38 is a schematic exploded view of a combined structure of a loudspeaker peripheral and a loudspeaker base according to an exemplary embodiment of the present disclosure.

FIG. 35 is a pin diagram of a connection detector 2122 according to an embodiment of this application. In an exemplary embodiment, as shown in FIG. 38, according to an embodiment of this application, the loudspeaker base 140 includes a rotary table 22 disposed on an upper surface, a base support 298 disposed in the middle of the base, and a base underframe 299 disposed at the bottom. The rotary table 22 is a rotation mechanism. As shown in FIG. 38, during the mounting of the loudspeaker base 140, the base support 298 is mounted on the base underframe 299. Circuit parts such as a base power supply 23 and a base processing unit 24 shown in FIG. 41 are disposed inside the base support 298. The rotary table 22 is disposed at an upper part of the base support 298

Figure 39:
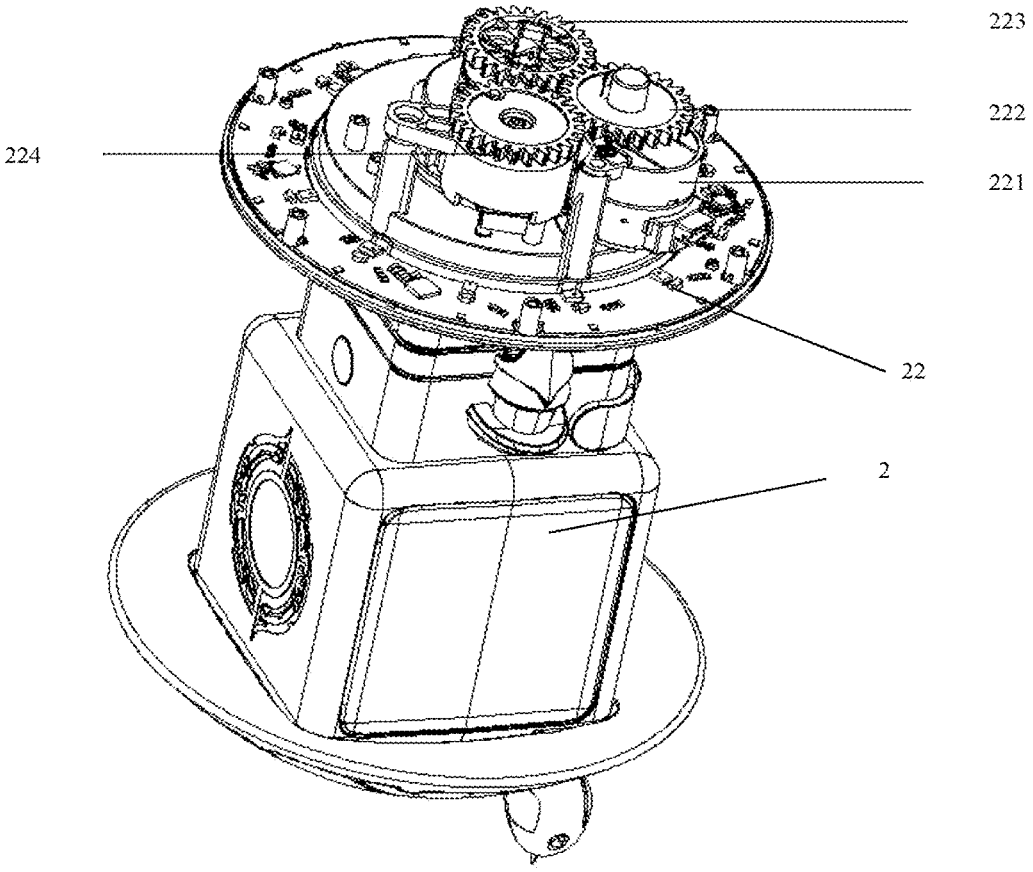
FIG. 39 is a schematic structural diagram of a rotary table according to an exemplary embodiment of the present disclosure.

FIG. 39 shows a specific structure of a rotary table 22 according to an exemplary embodiment of the present disclosure. As shown in FIG. 39, the base magnet part 2111 is mounted on the rotary table 22 disposed on the upper surface of the loudspeaker base 140. In this way, once the rotary table 22 rotates, the base magnet part 2111 is driven to rotate, and the base magnet part 2111 and the loudspeaker magnet part 1311 are connected through attraction, so that the loudspeaker peripheral 120 may be driven to rotate. The rotary table 22 is provided with a motor 221, a driving gear 222 driven by the motor, and a driven gear 223 driven by the driving gear 222. The driven gear 223 drives the loudspeaker base 140 to rotate. In an exemplary embodiment, the motor 221 may be a stepper motor, and may be alternatively another motor. In this way, when receiving a control instruction sent by the base processing unit 24 shown in FIG. 41, the motor 221 may adjust the rotation speed of the motor 221 according to the control instruction. The motor 221 drives the driving gear 222 to rotate. The driving gear 222 drives the driven gear 223 to rotate. The driven gear 223 drives the rotary table 22 to rotate. Therefore, the loudspeaker peripheral 120 is driven by using the base magnet part 2111 to rotate, thereby flexibly rotating the loudspeaker peripheral 120 according to the control instruction.

In an exemplary embodiment, as shown in FIG. 39, the rotary table 22 may be provided with an angle measurement gear 224 meshing with both the driving gear 222 and the driven gear 223. In this way, when the driving gear 222 and the driven gear 223 rotate, the angle measurement gear 224 may detect the rotation angle of the rotary table 22, to generate an angle signal. The angle measurement gear 224 transmits the angle signal to the motor 221. In this way, the motor 221 may adjust, according to the angle signal, the control signal outputted to the motor 221, and adjust the rotation speeds of the driving gear 222 and the driven gear 223 based on the rotation speed of the motor 221, thereby accurately controlling the rotation angle of the loudspeaker peripheral 120.

Figure 40:
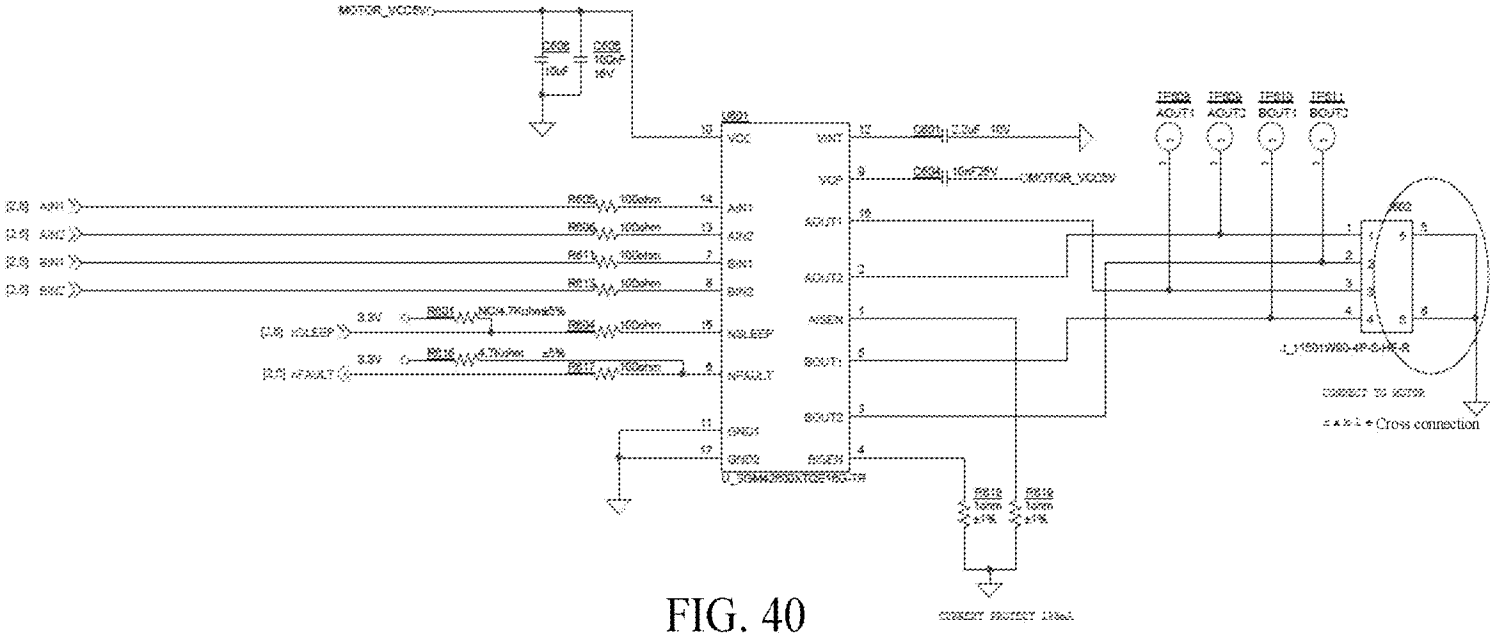
FIG. 40 is a pin diagram of an angle measurement gear according to an exemplary embodiment of the present disclosure.

FIG. 40 is a pin diagram of an angle measurement gear according to an embodiment of this application. In an exemplary embodiment, as shown in FIG. 41, the loudspeaker base 140 includes a pickup 27 with an opening in the loudspeaker base 140. The opening of the pickup 27 may be provided at any location in the loudspeaker base 140, for example, an upper part or a side face of the loudspeaker base 140, provided that the user's voice instruction can be collected. As shown in FIG. 41, the loudspeaker base 140 further includes a base processing unit 24 configured to output a direction control signal for the motor 221 according to a sound signal acquired by the pickup 27. The base processing unit 24 is a processor 10101, and the pickup 27 is a microphone 1012. After receiving the acquired sound signal, the pickup 27 transmits the sound signal to the base processing unit 24. The base processing unit 24 recognizes the voice signal of a person from the acquired sound signal, then determines the orientation of the person according to the voice signal of the person, so as to output a direction control signal to the motor 221 according to the orientation of the person. The motor 221 generates, according to the direction control signal, a rotation speed that drives the driving gear 222 and the driven gear 223, so as to control the loudspeaker peripheral 120 to rotate to face a direction in which the person speaks. The motor 221, the driving gear 222, and the driven gear 223 are the rotation mechanisms. Therefore, according to this embodiment, when a person speaks, the loudspeaker peripheral 120 may flexibly rotate according to the location of the person, so as to enable the person to hear more clearly the sound played by the loudspeaker.

Figure 43:
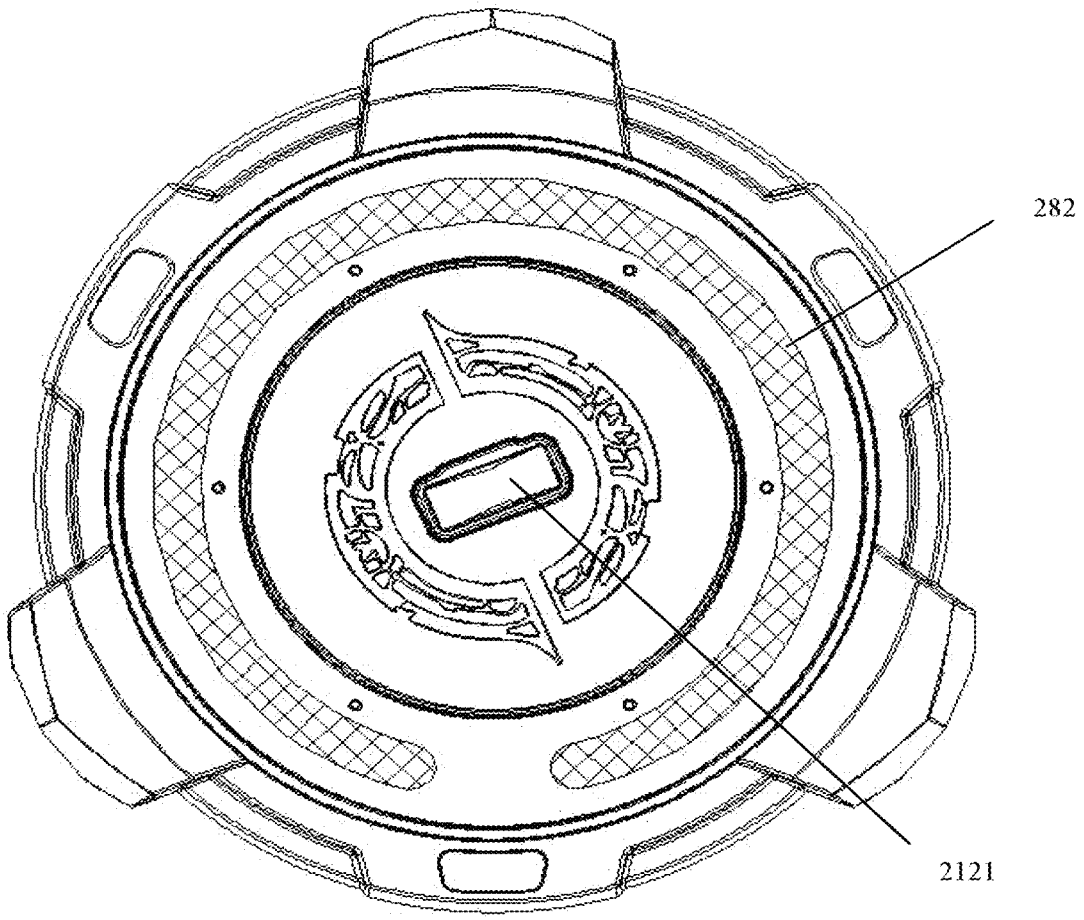
FIG. 43 is a top view of a loudspeaker base according to an exemplary embodiment of the present disclosure.

As shown in FIG. 43, the upper surface of the loudspeaker base 140 is provided with a tuning ring 281 and a tuning ring slider sensor 282 (as shown in FIG. 41) disposed under the tuning ring 281. As shown in FIG. 41, the tuning ring slider sensor 282 receives a slide signal generated on the tuning ring 281, and transmits a volume change signal to the base processing unit 24 provided in the loudspeaker base 140, so as to adjust an output of the base processing unit 24 to an audio output unit 25 and change the volume of audio outputted by the audio output unit 25 to the loudspeaker peripheral 120.

As shown in FIG. 43, in an exemplary embodiment, the tuning ring 281 is a circular ring with an opening, and may alternatively have another shape. When a user wants to turn up or turn down the volume of the loudspeaker peripheral 120, the user may slide with a finger along the tuning ring 281 clockwise or counterclockwise. The tuning ring slider sensor 282 can sense a slide of the finger on the tuning ring 281, that is, can receive a slide signal generated on the tuning ring 281, and transmit a volume change signal to the base processing unit 24 provided in the loudspeaker base 140.

In an exemplary embodiment, if the finger slides on the tuning ring 281 clockwise, a volume change signal represents a signal for turning up the volume. If the finger slides on the tuning ring 281 counterclockwise, a volume change signal represents a signal for turning down the volume. It may be alternatively set that if the finger slides on the tuning ring 281 clockwise, a volume change signal represents a signal for turning down the volume, and if the finger slides on the tuning ring 281 counterclockwise, a volume change signal represents a signal for turning up the volume.

In an exemplary embodiment, the tuning ring slider sensor 282 generates, according to a slide distance of the finger on the tuning ring 281, a volume change signal that is directly proportional to the slide distance. A longer slide distance of the user indicates that the user wants a larger volume change, so as to flexibly control the volume according to the user's requirements. In another exemplary embodiment, the tuning ring slider sensor 282 generates, according to slide duration of the finger on the tuning ring 281, a volume change signal that is directly proportional to the slide duration. Longer slide duration of the user indicates that the user wants a larger volume change, so as to flexibly control the volume according to the user's requirements.

After obtaining the volume change signal, the base processing unit 24 generates a control instruction to control the volume of audio outputted by the audio output unit 25 according to the volume change signal, and transmits the control instruction to the audio output unit 25. The audio output unit 25 outputs a sound signal with an adjusted volume, and the signal is connected to the first audio signal interface 152 through the second audio signal interface 262, for the speaker 12 in the loudspeaker peripheral 120 to play.

According to this exemplary embodiment, the tuning ring 281 and the tuning ring slider sensor 282 are disposed on the loudspeaker base 140, so that the volume of the played sound of the loudspeaker peripheral 120 may be flexibly adjusted as required.

Figure 44:
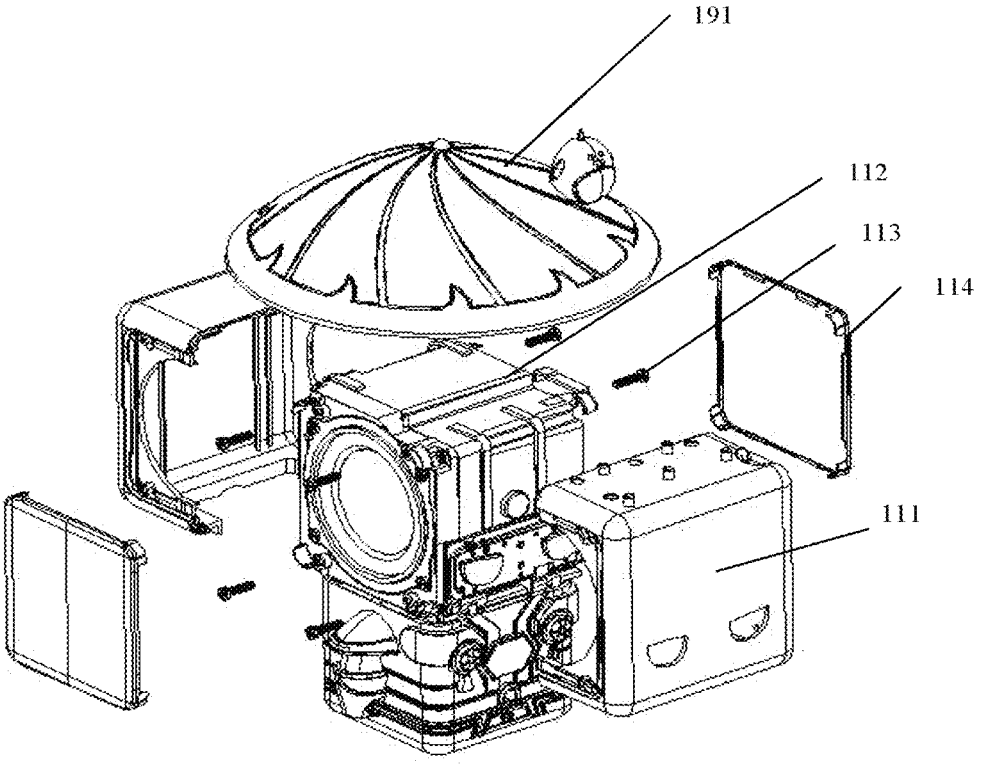
FIG. 44 is an exploded view of a loudspeaker peripheral according to an exemplary embodiment of the present disclosure.

As shown in FIG. 44, in an exemplary embodiment, the loudspeaker body 11 includes an outer housing 111 and an inner housing 112 located inside the outer housing 111. The loudspeaker peripheral 120 is carried in the inner housing 112. The outer housing 111 may be configured to form different forms, that is, different role figure 1022. For example, in a case of human face loudspeaker, different faces may be changed by using faces of different people printed on the outer housing 111, so that different role figures may be changed. For example, the outer housing 111 may print the face of Lu Bu or the face of Liu Bei, to form different character forms. The structure of the double housings makes it easy to change the form of the loudspeaker. When changing the form the loudspeaker, the inner housing 112 may not be changed, and it is only necessary change the outer housing 111. In addition to the outer housing 111, the loudspeaker body 11 may further include a tray body 1201. The outer housing 111 may be located on the tray body 1201, and the loudspeaker peripheral 120 is connected to the loudspeaker base 140 by the tray body 1201. For example, the tray body 1201 has an inserting part 13 formed by extending downward. As shown in FIG. 30, the upper surface of the loudspeaker base 140 is provided with a limit groove 21 that is concave downward. The inserting part 13 is inserted into the limit groove 21, to form an integrated structure of the loudspeaker peripheral 120 and the loudspeaker base 140.

As shown in FIG. 44, in an exemplary embodiment, the inner housing 112 and the outer housing 111 are fixed by a first fixing member 113. In an embodiment, the first fixing member 113 is a screw and a screw hole, and may be alternatively another fixing member. The screw is screwed into the screw holes in the outer housing 111 and the inner housing 112, so that the outer housing 111 and the inner housing 112 are fixed.

The speakers 12 are disposed in two opposite side faces of the inner housing 112. The outer housing 111 is provided with speaker openings 114 in two opposite corresponding side faces, to expose the speakers 12. As for the purpose of the speaker opening 114, the speaker does not change with the different forms of housings. Therefore, the speaker needs to be disposed on the inner housing 112. In this case, the speaker opening 114 needs to be provided to expose the speaker 12.

Figure 45:
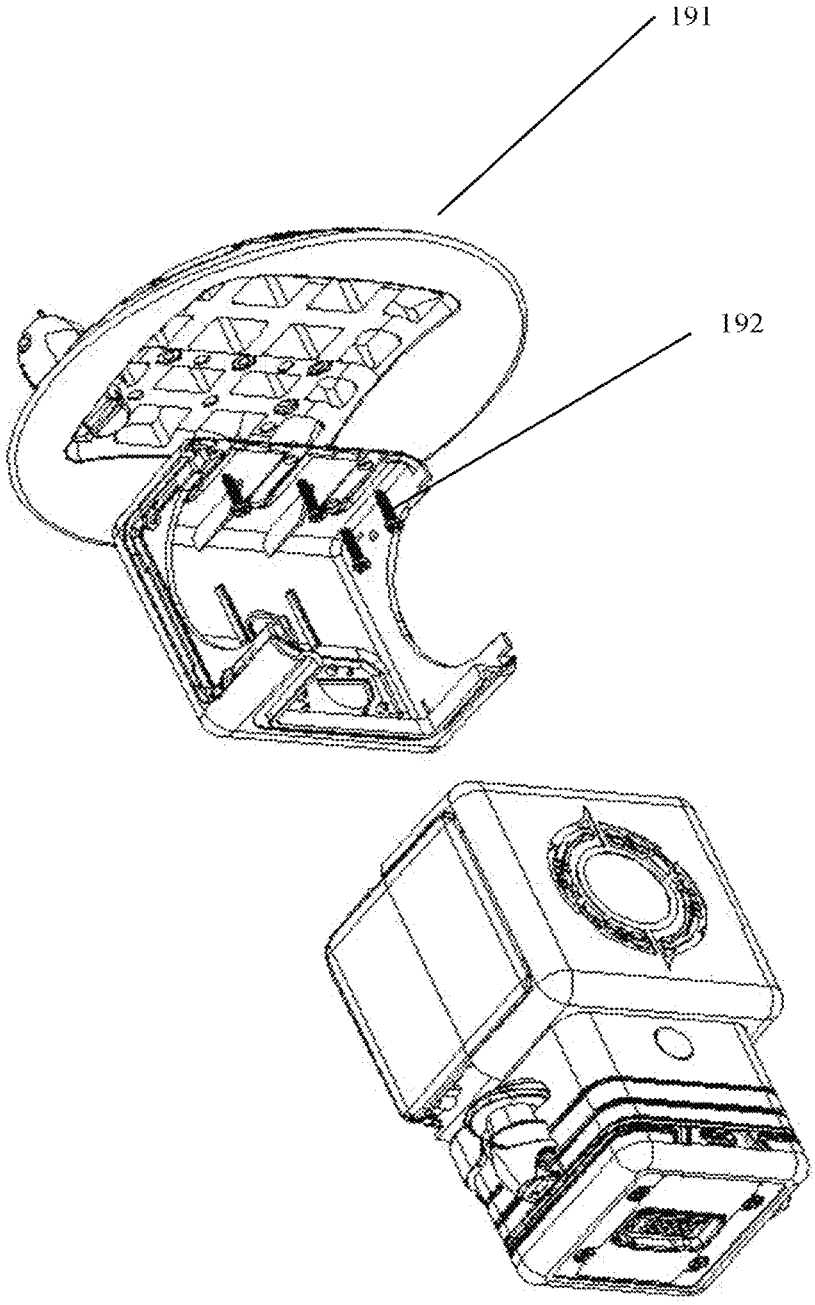
FIG. 45 is a schematic exploded view of a cover body and a loudspeaker according to an exemplary embodiment of the present disclosure.
Figure 46:
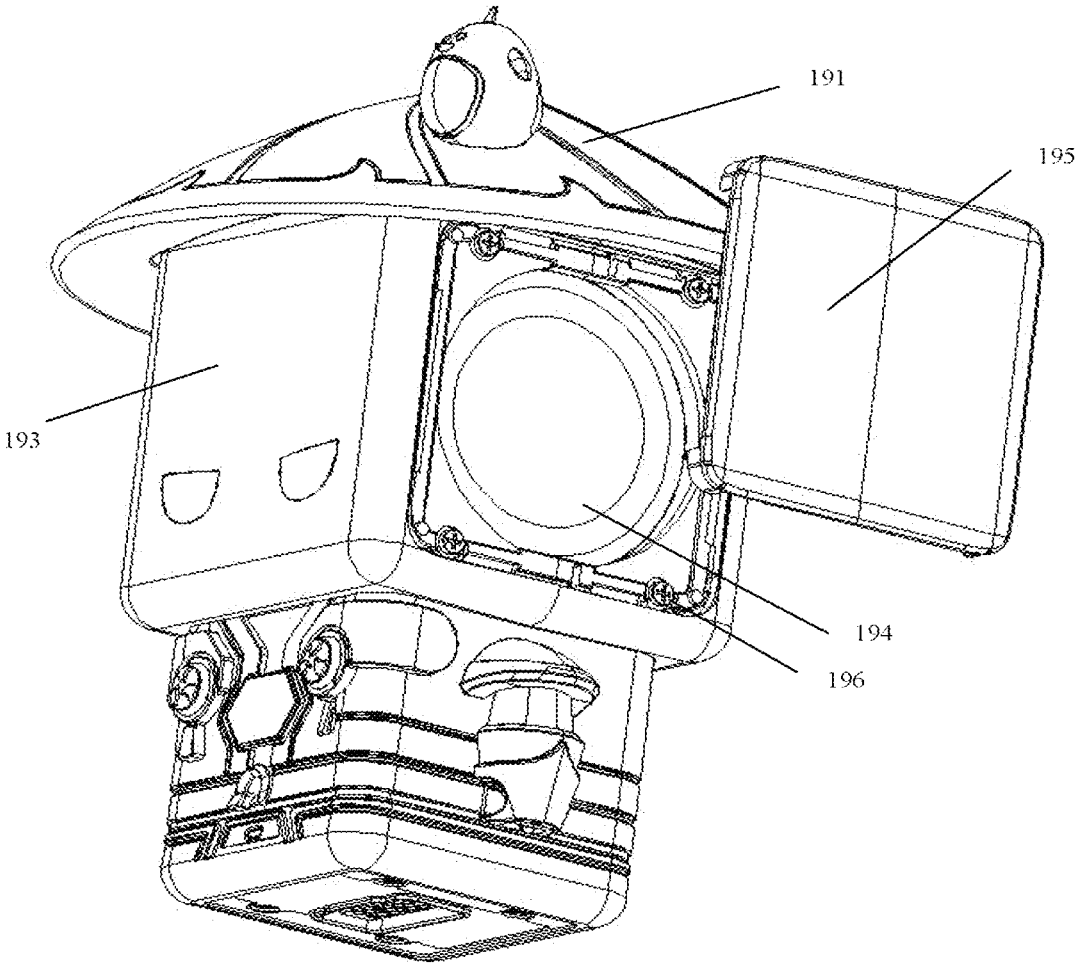
FIG. 46 is a schematic exploded view of an outer housing main body and a sealing plate according to an exemplary embodiment of the present disclosure.

As shown in FIG. 45 and FIG. 46, the loudspeaker peripheral 120 is provided with a cover body 191 disposed on the outer housing 111. The cover body 191 has the function of preventing the dust from falling into the inside of the loudspeaker peripheral 120 and the function of decoration at the same time. For example, the cover body 191 may be used as a hat for the loudspeaker character. The outer housing 111 includes an outer housing main body 193 and a mounting opening 194 provided in a side face of the outer housing main body 193.

The function of the outer housing main body 193 is to form a tight protection structure except for the mounting opening 194, so that the loudspeaker peripheral 120 inside may be prevented from squeeze and collision. The function of the mounting opening 194 is to facilitate the entry and exit of internal components (for example, the inner housing 112) during mounting. In an embodiment, the outer housing 111 is a cube. A rear side face of the cube has a mounting opening 194, and the other five faces do not have openings, so that a continuous integrated structure, that is, the outer housing main body 193, is formed.

The cover body 191 and the outer housing main body 193 are fixed through a second fixing member 192. In an embodiment, the second fixing members 192 are a screw and a screw hole, and may be alternatively another fixing member. For example, the screw holes are provided at corresponding locations of the cover body 191 and the outer housing main body 193, and the screw is screwed into the screw holes in the cover body 191 and the outer housing main body 193, so that the cover body 191 is fixed at the loudspeaker peripheral 120. The cover body 191 and the outer housing main body 193 are fixed through the second fixing member 192. Compared with a manner that a fastener extends from the bottom of the cover body 191 and the fastener is fastened is inserted into a fastener hole of the outer housing main body 193, the cover body 191 does not fall off easily, so that a connection between the cover body 191 and the loudspeaker peripheral 120 is tighter.

In an exemplary embodiment, as shown in FIG. 46, the outer housing 111 includes a sealing plate 195 covering the mounting opening. The outer housing main body 193 and the sealing plate 195 are fixed through a third fixing member 196. In an exemplary embodiment, the third fixing member 196 is a screw and a screw hole, and may be alternatively another fixing member. For example, a screw hole is provided at each corner of the sealing plate 195, and screw holes are correspondingly are provided at four corners of the mounting opening 194. The screw is screwed into the screw hole on the sealing plate 195 and is then screwed into the screw hole on the mounting opening 194, so that the sealing plate 195 tightly seals the mounting opening 194 through the screw and the screw hole. By using such a structure, the content of the loudspeaker peripheral 120 may easily pass through the mounting opening 194 to enter or leave the loudspeaker peripheral 120. The third fixing member 196 tightly seals the loudspeaker peripheral 120, so that the content of the loudspeaker peripheral 120 may be prevented from falling out.

In addition, in another exemplary embodiment, as shown in FIG. 41, the loudspeaker base 140 includes a base power supply 23, a base processing unit 24, and an audio output unit 25, and further includes a tuning ring slider sensor 282, a pickup 27, and a motor 221. The functions of the tuning ring slider sensor 282, the pickup 27, and the motor 221 are described in the foregoing, and the following describes the base power supply 23, the base processing unit 24, and the audio output unit 25. The base power supply 23 may supply power to the loudspeaker peripheral 120 when the loudspeaker peripheral 120 is mounted on the loudspeaker base 140. The base processing unit 24 is a core processing part in the base. The base processing unit 24 can generate an audio signal that needs to be played, and transmits the signal through the audio output unit 25 by using the second audio signal interface 262 and the first audio signal interface 152 to the speaker 12 in the loudspeaker peripheral 120 for playing. The base processing unit 24 may further recognize human voices from the voices acquired by the pickup 27, outputs a direction control signal to the motor 221 according to the orientation of the human voice, and drives the driving gear 222 and the driven gear by using the motor 221, so that the loudspeaker peripheral 120 may face a direction in which the person speaks. The base processing unit 24 may further respond, according to the tuning ring slider sensor 282, to a volume change signal generated by a slide of a human finger on the tuning ring 281, adjust an output of the audio output unit 25 accordingly, and eventually adjust the volume generated by the speaker 12 of the loudspeaker peripheral 120. The audio output unit 25 is a device that forms, according to an instruction of the base processing unit 24, a sound signal that needs to be played through the speaker. The instruction of the base processing unit 24 only indicates the sound that needs to be played and the volume of the sound, but the signal that needs to be played is formed by the audio output unit 25. By using a circuit structure inside the loudspeaker base 140, the content and volume of the outputted sound and the rotation angle of the loudspeaker peripheral 120 are accurately controlled.

As shown in FIG. 41, the base power supply 23 is connected to the base processing unit 24, and the base processing unit 24 is connected to the audio output unit 25. The base power supply 23 is connected to the second power signal interface 261, the base processing unit 24 is connected to the second control signal interface 263, and the audio output unit 25 is connected to the second audio signal interface 262. The second power signal interface 261 is an interface used for supplying, when the loudspeaker peripheral 120 is mounted on the loudspeaker base 140, power required for the loudspeaker peripheral 120 to play a sound. The second control signal interface 263 is an interface used for outputting a control signal to the loudspeaker peripheral 120 when the loudspeaker peripheral 120 is mounted on the loudspeaker base 140. The second audio signal interface 262 is an interface used for outputting, to the loudspeaker peripheral 120 when the loudspeaker peripheral 120 is mounted on the loudspeaker base 140, a sound that needs to be played by the loudspeaker peripheral 120.

In an exemplary embodiment, as shown in FIG. 42, the loudspeaker peripheral 120 includes a loudspeaker power supply 14, a loudspeaker processing unit 16, and a speaker 12. The loudspeaker power supply 14 is a power supply required to play a sound when the loudspeaker peripheral 120 works independently, that is, the loudspeaker peripheral 120 is not mounted on the loudspeaker base 140. The loudspeaker peripheral 120 does not work independently when being mounted on the loudspeaker base 140, and works relying on the base power supply 23 in the loudspeaker base 140. The loudspeaker processing unit 16 is a core processing chip in the loudspeaker peripheral 120, and completes data processing that needs to be performed when the loudspeaker peripheral 120 plays a sound. The loudspeaker power supply 14 is connected to the loudspeaker processing unit 16. The loudspeaker processing unit 16 is connected to the speaker 12. The first power signal interface 151, the first audio signal interface 152, and the first control signal interface 153 are all connected to the loudspeaker processing unit 16. The first power signal interface 151 is connected to the second power signal interface 261, to supply, to the loudspeaker peripheral 120 when the loudspeaker peripheral 120 is mounted on the loudspeaker base 140, the power outputted by the base power supply 23. The first audio signal interface 152 is connected to the second audio signal interface 262, to transmit, to the loudspeaker peripheral 120 for playing, the sound signal that is generated by the audio output unit 25 of the loudspeaker base 140 and needs to be played. The first control signal interface 153 is connected to the second control signal interface 263, to transmit, to the loudspeaker peripheral 120, the control signal transmitted by the loudspeaker base 140. By using the foregoing structures, the sound playing of the loudspeaker peripheral 120 is adequately controlled.

As shown in FIG. 42, in an exemplary embodiment, the loudspeaker power supply 14 and the first power signal interface 151 are connected to the base processing unit 24 by a switching circuit 199 disposed in the loudspeaker peripheral 120. When the loudspeaker peripheral 120 is mounted on the loudspeaker base 140, that is, the loudspeaker peripheral 120 does not work independently, a power signal can be received from the first power signal interface 151. In this case, the switching circuit 199 is disconnected from the loudspeaker power supply 14, and the loudspeaker peripheral 120 directly uses electric energy generated by the base power supply 23 in the loudspeaker base 140 to work. When the loudspeaker peripheral 120 is not mounted on the loudspeaker base 140, that is, the loudspeaker peripheral 120 works independently, a power signal cannot be received from the first power signal interface 151. In this case, the switching circuit 199 is disconnected from the first power signal interface 151, and the loudspeaker peripheral 120 keeps the connection to the loudspeaker power supply 14, and works by using the loudspeaker power supply 14 located inside the loudspeaker peripheral 120. In this way, a manner of connecting and disconnect the switching circuit 199 located inside the loudspeaker peripheral 120 is used to ensure that the loudspeaker peripheral 120 may work in two forms, namely, a built-in power supply and an external power supply, thereby implementing a double-mode working mode.

An example in which the smart peripheral is a loudspeaker is used. This exemplary embodiment of the present disclosure provides a loudspeaker system. The loudspeaker system provides a loudspeaker and a loudspeaker base that can be combined, so that the loudspeaker and the loudspeaker base can be used in two forms, namely, a combined form and a separate form.

In the combined form, the overall weight of the loudspeaker system is relatively heavy, but an AI voice function can be implemented, to facilitate use of users in home, office, and other scenarios. In the separate form, the loudspeaker system is divided into a loudspeaker and a loudspeaker base. The loudspeaker may be separately carried outdoors by a user and used as a Bluetooth loudspeaker. In addition, the loudspeaker may be designed into role figures of different IPs. In the combined form, the loudspeaker and the loudspeaker base in the loudspeaker system are connected to each other, and the loudspeaker system can implement an AI feedback function, in this case, the loudspeaker system is referred to as an IP robot.

A person of ordinary skill in the art will understand that all or some of the steps of the foregoing exemplary embodiments may be implemented by using hardware, such as circuitry, or may be implemented by a program instructing relevant hardware. The program may be stored in a non-transitory computer-readable storage medium. The storage medium may be a ROM, a magnetic disk, an optical disc, or the like.

The foregoing descriptions are merely exemplary embodiments of this application, but are not intended to limit this application. Any modification, equivalent replacement, or improvement made within the spirit and principle of this application shall fall within the protection scope of this application.

What is claimed is:

1. A loudspeaker system, comprising:

a loudspeaker base; and a loudspeaker peripheral that is independent of the loudspeaker base, the loudspeaker peripheral being shaped as a role figure, wherein the loudspeaker base and the loudspeaker peripheral are configured to connect through a contact connection or a non-contact connection, and the loudspeaker base and the loudspeaker peripheral are configured to provide personalized voice data, including an artificial intelligence (AI) generated first voice signal, corresponding to the role figure when connected.

2. The loudspeaker system according to claim 1, further comprising a plurality of loudspeaker peripherals, each having a different role figure, and each being configured to connect to the loudspeaker base.

3. The loudspeaker system according to claim 1, wherein the personalized voice data corresponding to the role figure comprises:

at least one of weather, alarm, music, news, frequency modulation (FM) broadcasting, and human-computer conversation.

4. The loudspeaker system according to claim 1, wherein the loudspeaker peripheral comprises a detachable tray body and the role figure, the tray body being provided with the role figure.

5. The loudspeaker system according to claim 1, wherein the loudspeaker base comprises processing circuitry and communication circuitry that is connected to the processing circuitry and that is configured to connect to a network, and at least one of the loudspeaker base and the loudspeaker peripheral are provided with a speaker.

6. The loudspeaker system according to claim 5, wherein the loudspeaker base further comprises a microphone assembly connected to the processing circuitry.

7. The loudspeaker system according to claim 6, wherein the loudspeaker base is configured to:

acquire, in a combined form, an input voice through the microphone assembly;

obtain, through the communication circuitry, the first voice signal for providing feedback on the input voice; and output the first voice signal to the loudspeaker peripheral through a second physical interface; and the loudspeaker peripheral is configured to receive the first voice signal through a first physical interface to play a sound corresponding to the first voice signal, the first physical interface and the second physical interface being physical interfaces that match each other.

8. The loudspeaker system according to claim 5, wherein the loudspeaker peripheral is provided with an electronic circuit configured to recognize the role figure.

9. The loudspeaker system according to claim 5, wherein the loudspeaker base is configured to:

obtain a user account during network configuration;

obtain, through the communication circuitry, a third voice signal for providing artificial intelligence (AI) strategy feedback in a battle in a case that the user account is in an online game state; and output the third voice signal to the loudspeaker peripheral through a second physical interface; and the loudspeaker peripheral is configured to receive the third voice signal through a first physical interface to play a sound corresponding to the third voice signal, the first physical interface and the second physical interface being physical interfaces that match each other.

10. The loudspeaker system according to claim 1, wherein the loudspeaker base is further provided with an adapter, and the loudspeaker base is connected to the loudspeaker peripheral by the adapter; and the adapter comprises a physical interface or a wireless connection circuit.

11. The loudspeaker system according to claim 1, wherein the loudspeaker base further comprises a first rotation mechanism, the first rotation mechanism being configured to drive the loudspeaker peripheral in a contact connection with the loudspeaker base to rotate.

12. The loudspeaker system according to claim 11, wherein the first rotation mechanism is configured to drive, in a case that a microphone assembly in the loudspeaker base receives a voice signal, the role figure on the loudspeaker peripheral to move toward a sound source location of the voice signal.

13. The loudspeaker system according to claim 1, wherein a second rotation mechanism is disposed in the loudspeaker base, the second rotation mechanism being configured to drive the loudspeaker peripheral to rotate.

14. The loudspeaker system according to claim 1, wherein the loudspeaker peripheral is disposed on the loudspeaker base;

the loudspeaker peripheral is disposed next to the loudspeaker base;

the loudspeaker peripheral is disposed under the loudspeaker base; or the loudspeaker peripheral is remotely connected to the loudspeaker base.

15. The loudspeaker system according to claim 14, wherein the loudspeaker peripheral is disposed on the loudspeaker base; and the bottom of the loudspeaker peripheral is provided with an insertion member, a top of the loudspeaker base is provided with a limit groove, and the loudspeaker peripheral is inserted into the limit groove through the insertion member.

16. The loudspeaker system according to claim 14, wherein the loudspeaker peripheral is disposed under the loudspeaker base; and a top of the loudspeaker peripheral is provided with an insertion member, the bottom of the loudspeaker base is provided with a limit groove, and the loudspeaker peripheral is inserted into the limit groove through the insertion member.

17. The loudspeaker system according to claim 1, wherein magnetic parts with corresponding locations are disposed between the loudspeaker peripheral and the loudspeaker base.

18. A loudspeaker peripheral, shaped as a role figure, comprising:

an electronic identifier of the role figure; and circuitry configured to connect, via a contact connection or a non-contact connection, to a loudspeaker base, and enable the loudspeaker base to provide personalized voice data, including an artificial intelligence (AI) generated first voice signal, corresponding to the role figure when connected to the loudspeaker base.

19. The loudspeaker peripheral according to claim 18, wherein a rotation mechanism is disposed in the loudspeaker peripheral, the rotation mechanism being configured to drive the loudspeaker peripheral to rotate.

20. A loudspeaker base, comprising:

communication circuitry configured to connect to a network; and processing circuitry connected to the communication circuitry and configured to:

connect, via a contact connection or a non-contact connection, to a loudspeaker peripheral, the loudspeaker peripheral being shaped as a role figure, at least one of the loudspeaker base and the loudspeaker peripheral being provided with a speaker, and provide personalized voice data, including an artificial intelligence (AI) generated first voice signal, corresponding to the role figure when connected to the loudspeaker peripheral.

* * * * *